US008676108B2

(12) United States Patent
Hasegawa et al.

(10) Patent No.: US 8,676,108 B2
(45) Date of Patent: Mar. 18, 2014

(54) PROTECTING AGENT SUPPLYING MEMBER, PROTECTIVE LAYER FORMING DEVICE, AND IMAGE FORMING APPARATUS

(75) Inventors: Kunio Hasegawa, Kanagawa (JP); Hiroshi Nakai, Kanagawa (JP); Shinya Tanaka, Kanagawa (JP); Kohsuke Yamamoto, Kanagawa (JP); Taichi Urayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 13/137,579

(22) Filed: Aug. 26, 2011

(65) Prior Publication Data

US 2012/0063825 A1 Mar. 15, 2012

(30) Foreign Application Priority Data

Sep. 9, 2010 (JP) ..... 2010-202368
Nov. 1, 2010 (JP) ..... 2010-244989

(51) Int. Cl.
*G03G 21/00* (2006.01)

(52) U.S. Cl.
USPC ..... 399/346

(58) Field of Classification Search
USPC ..... 399/343, 345, 346, 349, 350
See application file for complete search history.

(56) References Cited

U.S. PATENT DOCUMENTS

| | | | | |
|---|---|---|---|---|
| 6,562,529 | B1 * | 5/2003 | Kojima et al. | 430/56 |
| 7,343,132 | B2 * | 3/2008 | Kimura et al. | 399/346 |
| 2009/0311014 | A1 | 12/2009 | Tanaka et al. | |
| 2010/0034560 | A1 | 2/2010 | Tanaka et al. | |
| 2010/0183972 | A1 | 7/2010 | Hasegawa et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |

FOREIGN PATENT DOCUMENTS

| | | | |
|---|---|---|---|
| JP | 2006350240 | A | 12/2006 |
| JP | 2007065100 | A | 3/2007 |
| JP | 2007-293240 | A | 11/2007 |
| JP | 2009150986 | A | 7/2009 |

* cited by examiner

*Primary Examiner* — Hoang Ngo
(74) *Attorney, Agent, or Firm* — Harness, Dickey & Pierce, P.L.C.

(57) ABSTRACT

To provide a protecting agent supplying member, containing a core, and a foam layer formed on a periphery of the core, wherein the protecting agent supplying member is in the shape of a roller, and wherein the foam layer has concavities regularly arranged in a surface thereof.

20 Claims, 9 Drawing Sheets

PROTECTING AGENT SUPPLYING MEMBER, PROTECTIVE LAYER FORMING DEVICE, AND IMAGE FORMING APPARATUS

BACKGROUND OF THE INVENTION

1. Field of the Invention

The present invention relates to a protecting agent supplying member, a protective layer forming device, and an image forming apparatus.

2. Description of the Background

Regardless of a developing system for use, an image forming apparatus of a conventional electrophotographic system generally uniformly charges its image bearing member (commonly referred to as a photoconductor), generally in the shape of a drum or a belt, while rotating the image bearing member, forms a latent image pattern on the image bearing member using laser light or the like, and making the latent image visualize to form a visible image by its developing device, and transfers the visible image (a toner image) to a transfer medium to form an image.

Some toner residuals, which have not been transferred, remain on the image bearing member after transferring the toner image to the transfer medium. If the image bearing member is subjected to the charging process with bearing such residuals, the residuals impair the uniform charging of the image bearing member. Therefore, it is common that the toner residuals or the like remained on the image bearing member is removed in a cleaning step, after the transferring step, and the charging is performed in the state where the surface of the image bearing member has been sufficiently cleaned.

In each step of the image formation, there are various physical stress and electric stress. The image bearing member that has received the various physical stress or electric stress changes its surface condition as time passes.

For example, it has been known that, among the stress mentioned above, the stress caused by the friction in the cleaning step abrades the image bearing member, and gives scratches on the image bearing member.

To solve the problem as mentioned, it has been known that it is effective to apply a protecting agent onto the image bearing member. With the application of the protecting agent onto the image bearing member, the friction coefficient of the surface of the image bearing member reduces, which inhibits the deterioration of a cleaning blade or the image bearing member, and the releasing ability of the depositions, such as toner residuals from the transferring, on the image bearing member is improved, which can prevent cleaning failure occur in time, or prevent occurrences of filming.

There is disclosed, as a technique for applying a protecting agent onto an image bearing member, a protective layer forming device containing a protecting agent block, a protecting agent supplying member formed of a rotatable brush member configured to be in contact with the protecting agent block and to apply the protecting agent bearing thereon to the image bearing member, and a protecting agent pressing member configured to press the protecting agent block to thereby bring the protecting agent block into contact with the protecting agent supplying member (see, for example, Japanese Patent Application Laid-Open (JP-A) No. 2007-65100).

In this proposed technique, however, a large amount of the powder of the protecting agent scraped from the protecting agent block by the rotation of the rotatable brush member is scattered, which generates a large amount of the waste of the protecting agent. Moreover, since the brush fibers collapse or are deteriorated with time, the consumption amount of the protecting agent is not stable, and therefore it may not be able to supply a constant amount of the protecting agent for a long period of time.

To encounter this problem, there is disclosed a technique using, as a protecting agent supplying member of a protective layer forming device, a protecting agent supplying member which has a foam layer and is in the form of a roller (see, for example, JP-A No. 2009-150986). In accordance with this proposed technique, scattering of the protecting agent powder due to the abrasion hardly occurs.

However, in this technique, the protecting agent supplying member, which has a foam layer and is in the form of a roller, is soft and thus the force thereof for scraping the protecting agent block is small. As a result, the protecting agent cannot be sufficiently supplied to the image bearing member, and it may be difficult to sufficiently prevent filming of the image bearing member. If the amount of the protecting agent block scraped by the protecting agent supplying member is attempted to increase by pressing the protecting agent block at high pressure, large load is applied to protecting agent block and the protecting agent block is not evenly scraped in the length direction, which cause the variation in the supplied amount of the protecting agent in the length direction of the protecting agent block. As a result, there is no protection effect of the protecting agent on the portion of the image bearing member where the supplied amount of the protecting agent is small, and filming occurs on such portion.

Accordingly, it is current situation that a protecting agent supplying member, which has a foam layer, is in the form of a roller, is capable of reducing the scattering of the protecting agent powder generated by abrasion, does not need use a large amount of the protecting agent, and is capable of preventing filming, is desired, as well as a protective layer forming device and image forming apparatus using the protecting agent supplying member as described.

SUMMARY OF THE INVENTION

The present invention aims to solve the various problems in the art, and achieve the following object. An object of the present invention is to provide a protecting agent supplying member, which is capable of preventing scattering of a powdery protecting agent generated as rubbed by the roller-shaped protecting agent supplying member having a foam layer, suppressing a consumption amount of the protecting agent, and preventing filming, as well as providing a protective layer forming device, and image forming apparatus both of which uses the protecting agent supplying member.

The means for solving the aforementioned problems are as follows:

<1> A protecting agent supplying member, containing:

a core; and a foam layer formed on a periphery of the core, wherein the protecting agent supplying member is in the shape of a roller, and wherein the foam layer has concavities regularly arranged in a surface thereof.

<2> The protecting agent supplying member according to <1>, wherein the protecting agent supplying member satisfies the relationships of:

$a1 \geq 0.5$ mm, and $a2 \geq 0.2$ mm, where a1 is the average distance between an internal perimeter surface of the foam layer and a bottom face of the concavity, and a2 is the average distance between the bottom face of the concavity and a top face of the concavity.

<3> The protecting agent supplying member according to any of <1> or <2>, wherein the protecting agent supplying member has the ratio c/b in the range of $0.25 \leq c/b \leq 0.75$, where b is the average distance between a couple of the concavities next to each other, and c is the average width of the form layer present between a couple of the concavities next to each other.

<4> The protecting agent supplying member according to any one of <1> to <3>, wherein the concavities are arranged in a lattice pattern.

<5> The protecting agent supplying member according to <4>, wherein the concavities arranged in the lattice pattern have the ratio c1/b1 and the ratio c2/b2 in the respective ranges of:

$0.25 \leq c1/b1 \leq 0.75$, and $0.25 \leq c2/b2 \leq 0.75$, where b1 is the average distance between a couple of the concavities next to each other with respect to one direction, c1 is the average width of the foam layer present between a couple of the concavities next to each other with respect to the one direction, b2 is the average distance between a couple of the concavities next to each other with respect to the direction perpendicular to the one direction, and c2 is the average width of the foam layer present between a couple of the concavities next to each other with respect to the direction perpendicular to the one direction.

<6> The protecting agent supplying member according to any one of <1> to <5>, wherein the foam layer contains polyurethane foam.

<7> The protecting agent supplying member according to any one of <1> to <6>, wherein the foam layer is a foam layer of an interconnected cell structure.

<8> The protecting agent supplying member according to any one of <1> to <7>, wherein the foam layer contains 25 cells to 300 cells per inch, and has hardness of 50 N to 500 N.

<9> A protective layer forming device, containing:

a protecting agent block; and the protecting agent supplying member as defined in any one of <1> to <8>.

<10> The protective layer forming device according to <9>, wherein the protecting agent block contains a fatty acid metal salt and an inorganic lubricant.

<11> The protective layer forming device according to <10>, wherein the fatty acid metal salt is zinc stearate.

<12> The protective layer forming device according to any of <10> or <11>, wherein the inorganic lubricant is boron nitride.

<13> The protective layer forming device according to any one of <9> to <12>, further containing:

a pressing force applying member configured to press the protecting agent block so as to bring the protecting agent block into contact with the protecting agent supplying member; and a protective layer forming member configured to thinly level a protecting agent provided on a surface of an image bearing member to form a protective layer.

<14> An image forming method, containing:

forming a latent electrostatic image on an image bearing member;

developing the latent electrostatic image with a toner to form a visible image;

transferring the visible image to a recording medium;

applying a protecting agent to a surface of the image bearing member, from which the visible image has been transferred, to form a protective layer; and fixing the transferred visible image on the recording medium, wherein the applying is performed by the protective layer forming device as defined in any one of <9> to <13>.

<15> An image forming apparatus, containing:

an image bearing member;

a latent electrostatic image forming member configured to form a latent electrostatic image on the image bearing member;

a developing unit configured to develop the latent electrostatic image with a toner to form a visible image;

a transferring unit configured to transfer the visible image onto a recording medium;

a protective layer forming unit configured to provide a protecting agent to a surface of the image bearing member, from which the visible image has been transferred, to form a protective layer; and a fixing unit configured to fix the transferred visible image on the recording medium, wherein the protective layer forming unit is the protective layer forming device as defined in any one of <9> to <13>.

<16> A process cartridge, containing:

an image bearing member; and the protective layer forming device as defined in any one of <9> to <13>, where the process cartridge is detachably mounted in a main body of an image forming apparatus.

The present invention can solve the various problems in the art mentioned earlier, and can provide a protecting agent supplying member, which is capable of preventing scattering of a powdery protecting agent generated as rubbed by the roller-shaped protecting agent supplying member having a foam layer, suppressing a consumption amount of the protecting agent, and preventing filming, as well as providing a protective layer forming device, and image forming apparatus both of which uses the protecting agent supplying member.

DETAILED DESCRIPTION OF THE INVENTION

Protecting Agent Supplying Member

Figure 1:
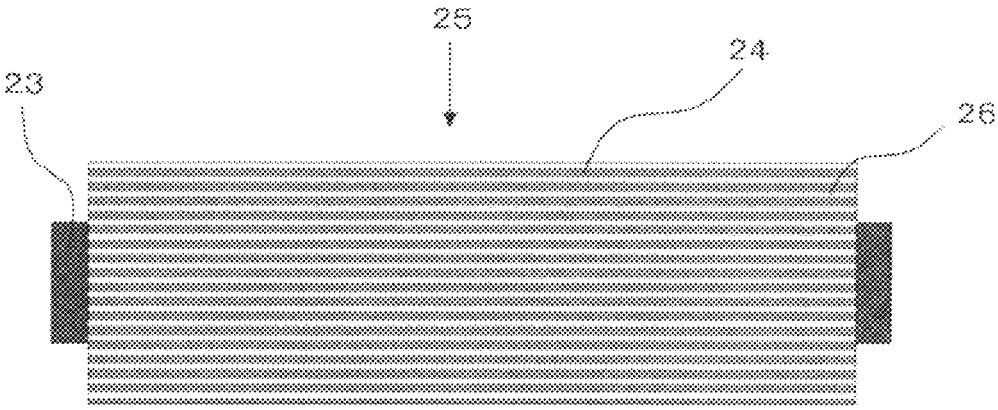
FIG. 1 is a schematic front view illustrating one example of the protecting agent supplying member of the present invention.

The protecting agent supplying member of the present invention contains at least a core, and a foam layer, and may further contain other members, if necessary.

The protecting agent supplying member is in the shape of a roller.

Core

The material, shape, size, and structure of the core are appropriately selected depending on the intended purpose without any restriction.

Examples of the material of the core include a resin, and a metal. Examples of the resin include an epoxy resin, and a phenol resin. Examples of the metal include iron, aluminum, and stainless steel.

Examples of the shape of the core include a column shape, and a cylindrical shape.

Foam Layer

The foam layer is formed on the periphery of the core.

The foam layer has concavities in the surface thereof.

At the area (the nipping part) where the protecting agent supplying member and the image bearing member are brought into contact with each other, the following two activities occur at the same time: (1) an activity that the protecting agent supplying member applies the protecting agent to the image bearing member, (2) and an activity that the protecting agent supplying member removed the protecting agent from the image bearing member.

Since the foam layer has the concavities in the surface thereof, the contact area of the protecting agent supplying member and the protecting agent block is small. Because of the small contact area, the pressure applied to the image bearing member is reduced, the activity that the protecting agent applied to the image bearing member is removed is inhibited.

The applied protecting agent will not be scraped for a long period of time, and the image bearing member can be continuously protected. As a result, filming of the image bearing member can be prevented.

Concavities

The foam layer has concavities, which are regularly arranged, in the surface thereof.

The term "regularly arranged" means that concavities substantially in the identical shape, and substantially in the same size are substantially uniformly arranged in the surface of the foam layer.

The average distance (a1) between the internal perimeter surface of the foam layer and the bottom face of the concavity is appropriately selected depending on the intended purpose without any restriction, but it is preferably 0.5 mm or larger ($a1 \geq 0.5$ mm), more preferably 2.0 mm to 2.8 mm (2.0 mm$\leq a1 \leq$2.8 mm). When the average distance (a1) is smaller than 0.5 mm, the effect of preventing the filming of the image bearing member, and effect of preventing contamination of the charging member may be poor. When the average distance (a1) is within the more preferable range mentioned above, conversely, it is advantageous because an excellent effect of preventing filming of the image bearing member is attained.

The average distance (a1) between the internal perimeter surface of the foam layer and the bottom face of the concavity is the average value of values obtained by measuring the distance the internal perimeter surface of the foam layer and the bottom face of the concavity at randomly selected 5 spots.

The average distance (a2) between the bottom face and the top face of the concavity is appropriately selected depending on the intended purpose without any restriction, but it is preferably 0.2 mm or larger ($a2 \geq 0.2$ mm), more preferably 0.2 mm to 1.0 mm (0.2 mm$\leq a2 \leq$1.0 mm). When the average distance (a2) is smaller than 0.2 mm, the effect of preventing the filming of the image bearing member, and effect of preventing contamination of the charging member may be poor. When the average distance (a2) is within the more preferable range, conversely, it is advantageous because an excellent effect of preventing filming of the image bearing member is attained.

The average distance (a2) between the bottom face and top face of the concavity is the average value of values obtained by measuring the distance between the bottom face and top face of the concavity at randomly selected 5 spots.

The average distance (b) between a couple of the concavities next to each other, the average width (c) of the foam layer present between a couple of the concavities next to each other, and the ratio (c/b) are appropriately selected depending on the intended purpose without any restriction, but the ratio (c/b) is preferably 0.25 to 0.75 ($0.25 \leq c/b \leq 0.75$). When the ratio (c/b) is less than 0.25, the effect of preventing the filming of the image bearing member may be poor. When the ratio (c/b) is more than 0.75, the effect of preventing the filming of the image bearing member may be poor. When the ratio (c/b) is within the preferable range mentioned above, it is advantageous because an excellent effect of preventing filming of the image bearing member can be attained.

Moreover, in the case where the average distance (a1) is 2.0 mm$\leq a1 \leq$2.7 mm, the ratio (c/b) is preferably $0.5 \leq c/b \leq 0.75$.

In the case where the average distance (a1) is 2.7 mm$\leq a1 \leq$2.8 mm, the ratio (c/b) is preferably $0.25 \leq c/b \leq 0.5$.

The average distance (b) of a couple of the concavities next to each other is obtained by calculating the average value from values obtained by measuring the two neighboring concavities at randomly selected 5 spots.

The average width (c) of the foam layer present between a couple of the concavities next to each other can be obtained by calculating the average value from values obtained by measuring the width of the foam layer present between a couple of the concavities next to each other at randomly selected 5 spots.

The shapes, and arrangement of the concavities in the foam layer are appropriately selected depending on the intended purpose without any restriction. Examples of the shapes of the concavities include substantially a rectangular prism.

Examples of the shapes and the arrangement of the concavities in the foam layer include an embodiment thereof where the concavities each substantially in the shape of a rectangular prism are aligned in the direction substantially parallel to the axial direction of the protecting agent supplying member and arranged to have a constant space therebetween in the circumferential direction of the protecting agent supplying member, and an embodiment where the concavities each substantially in the shape of a rectangular prism are arranged in a lattice pattern.

In the case where the concavities are arranged in a lattice pattern (also referred to as "a checked pattern"), the ratio (c1/b2) of the average width (c1) of the foam layer present between a couple of the concavities next to each other and the average distance (b1) between a couple of the concavities next to each other in one direction is appropriately selected depending on the intended purpose without any restriction, but it is preferably $0.25 \leq c1/b1 \leq 0.75$. When the ratio (c1/b1) is less than 0.25, an effect of preventing filming of the image bearing member may be poor. When the ratio (c1/b1) is more than 0.75, an effect of preventing filming of the image bearing member may be poor. When the ratio (c1/b1) is within the preferable range mentioned above, conversely, it is advantageous because an excellent effect of preventing filming of the image bearing member can be attained.

In the case where the concavities are arranged in a lattice pattern, moreover, the ratio (c2/b2) of the average width (c2) of the foam layer present between a couple of the concavities next to each other and the average distance (b2) between a couple of the concavities next to each other in the direction perpendicular to the one direction mentioned above is appropriately selected depending on the intended purpose without any restriction, but it is preferably $0.25 \leq c2/b2 \leq 0.75$. When the ratio (c2/b2) is less than 0.25, an effect of preventing filming of the image bearing member may be poor. When the ratio (c2/b2) is more than 0.75, an effect of preventing filming of the image bearing member may be poor. When the ratio (c2/b2) is within the preferable range mentioned above, conversely, it is advantageous because an excellent effect of preventing filming of the image bearing member can be attained.

The average distance (b1) of a couple of the concavities next each other, and the average distance (b2) of a couple of the concavities next to each other can be each obtained by measuring the distance (b1') of the two neighboring concavities or the distance (b2') of the two neighboring concavities at randomly selected 5 spots, and calculating the average value from the measured values.

The average width (c1) of the foam layer present between a couple of the concavities next to each other and the average width (c2) of the foam layer present between a couple of the concavities next to each other can be each obtained by measuring the width (c1') of the foam layer present between a couple of the concavities next to each other or the width (c2') of the foam layer present between a couple of the concavities next to each other at randomly selected 5 spots, and calculating the average value from the measured values.

Figure 2:
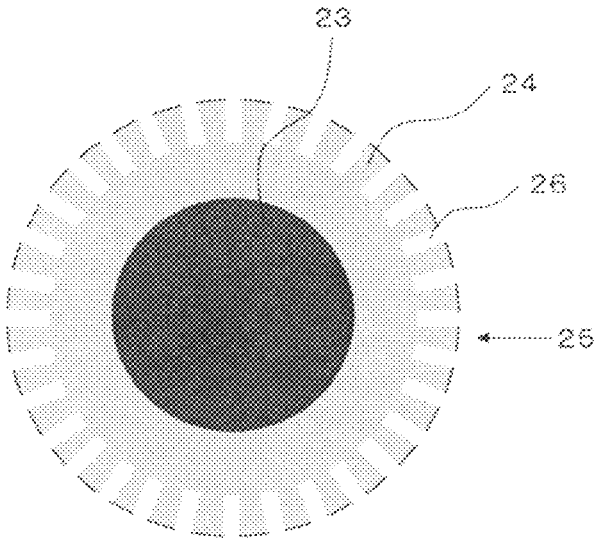
FIG. 2 is a cross-sectional view of the protecting agent supplying member of FIG. 1.

The shapes, and arrangement of the concavities are explained with reference to drawings. FIG. 1 is a schematic front view illustrating one example of the protecting agent supplying member of the present invention. FIG. 2 is a cross-sectional view of the protecting agent supplying member of FIG. 1. The protecting agent supplying member 25 of FIGS. 1 and 2 has a core 23 in the shape of a roller, and a cylindrical foam layer 24 provided on the periphery of the core 23. Moreover, in the form layer 24, concavities 26 are aligned in the direction substantially parallel to the axial direction of the protecting agent supplying member 25, and substantially uniformly provided at constant intervals along the circumferential direction of the protecting agent supplying member 25. The concavities 26 are each in the cubic shape.

Figure 3:
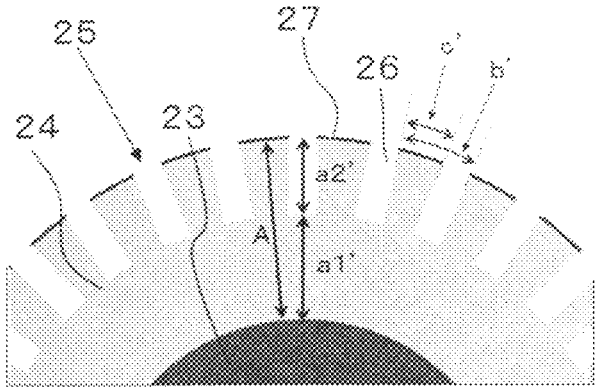
FIG. 3 is an enlarged view of the part illustrated in FIG. 2.

FIG. 3 is an enlarged partial view of FIG. 2. The sign a1' represents the distance between the internal perimeter surface of the foam layer and the bottom face of the concavity, the sign a2' represents the distance between the bottom face of the concavity and the top face of the concavity, the sign b' represents the distance between a couple of the concavities next to each other, and the sign c' represents the width of the foam layer present between a couple of the concavities next to each other.

In the present specification, the term concavities means concavities 26 formed in the outermost surface 27 of the foam layer 24 with the outer surface 27 standing as a standard plane. In the case where the bottom face of the concavity is not a flat surface, the standard for the bottom face of the concavity is based on the intersection point of the line connecting a center of the minimum distance of the both walls in the concavity and a center of the cross-sectional circle of the roller-shaped protecting agent supplying member including the center of the walls of the concavity, and the bottom face of the concavity, for measuring the distance between the internal perimeter surface of the foam layer and the bottom face of the concavity.

The distance (a2') between the bottom face of the concavity and the top face of the concavity is, in another word, the depth of the concavity. The top face of the concavity is the plane constituting part of the outermost surface 27 of the foam layer. The distance (b') between a couple of the concavities next to each other is a distance between one end of the top face of the concavity at the side of the other concavity among two neighboring concavities and one end of the top face of the other concavity facing the side of the neighboring concavity as mentioned among the two neighboring concavities. The width (c') of the foam layer present between a couple of the concavities next to each other is a width of the foam layer present in the width direction between two neighboring concavities in the outer surface 27 of the foam layer.

Figure 5:
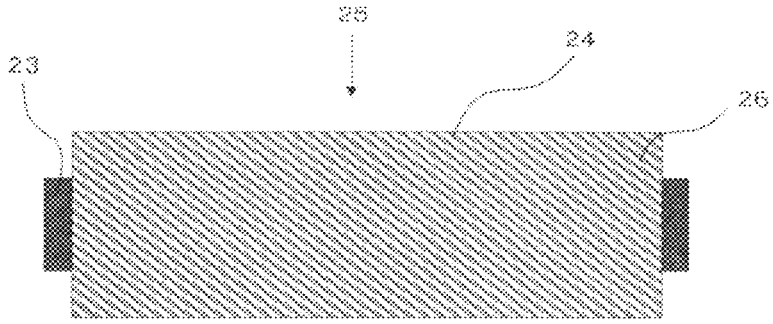
FIG. 5 is a schematic front view illustrating another example of the protecting agent supplying member of the present invention.
Figure 6:
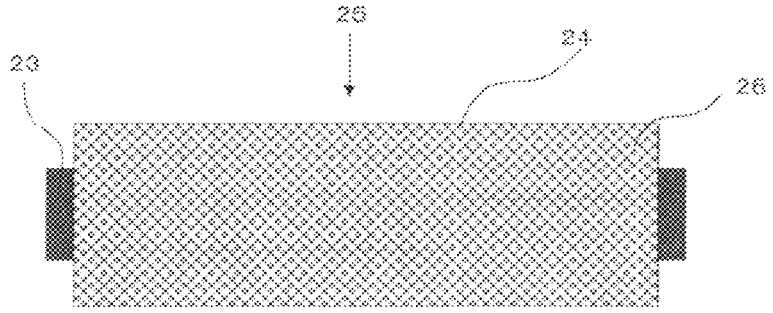
FIG. 6 is a schematic front view illustrating another example of the protecting agent supplying member of the present invention.
Figure 7:
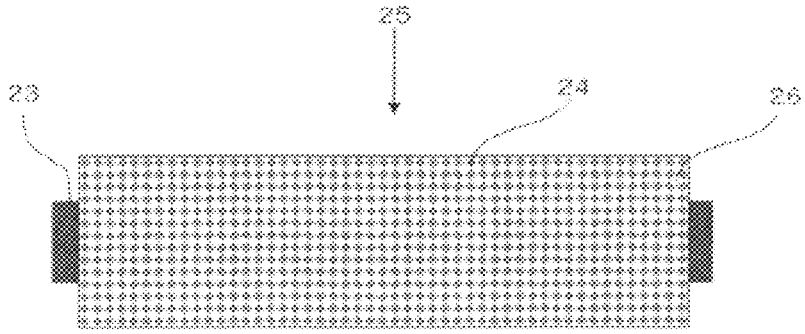
FIG. 7 is a schematic front view illustrating another example of the protecting agent supplying member of the present invention.

Other examples of the arrangement of the concavities are illustrated in FIGS. 5 to 7.

FIG. 5 is a schematic front view of another example of the protecting agent supplying member. In FIG. 5, the protecting agent supplying member 25 is in the shape of a roller, and has a core 23, and a cylindrical foam layer 24 at the periphery of the core 23. Moreover, in the form layer 24, concavities 26 are aligned in the direction with an angle to the axial direction of the protecting agent supplying member 25, and substantially uniformly provided at constant intervals in the direction perpendicular to a direction parallel to the direction with the certain angle mentioned above. The concavities 26 are each substantially in the shape of a quadrangular prism and spirally arranged.

FIG. 6 is a schematic front view illustrating another example of the protecting agent supplying member. The protecting agent supplying member 25 illustrated in FIG. 6 contains a core 23 in the shape of a roller, and a cylindrical foam layer 24 at the periphery of the core 23. Moreover, in the form layer 24, concavities 26 each of which is substantially in the shape of a rectangular prism, are uniformly formed in a lattice pattern (also referred to as a checked pattern). The protecting agent supplying member has the lattice pattern in which each concavity and the foam body are alternately aligned in the axial direction and the circumferential direction (i.e., the direction perpendicular to the axial direction).

FIG. 7 is a schematic front view illustrating another example of the protecting agent supplying member. The protecting agent supplying member 25 illustrated in FIG. 7 contains a core 23 in the shape of a roller, and a cylindrical foam layer 24 at the periphery of the core 23. Moreover, in the form layer 24, concavities 26 each of which is substantially in the shape of a rectangular prism, are uniformly formed in a lattice pattern (also referred to as a checked pattern). The protecting agent supplying member has the lattice pattern in which the concavities and the foam body are alternately aligned in the axial direction with 45° to the axial direction and the direction perpendicular to the direction as mentioned.

The distance (b1') between a couple of the concavities next to each other, the width (c1') of the foam layer present between a couple of the concavities next to each other, the distance (b2') between a couple of the concavities next to each other, and the width (c2') of the foam layer present between a couple of the concavities next to each other will be explained with reference to the drawings.

Figure 8:
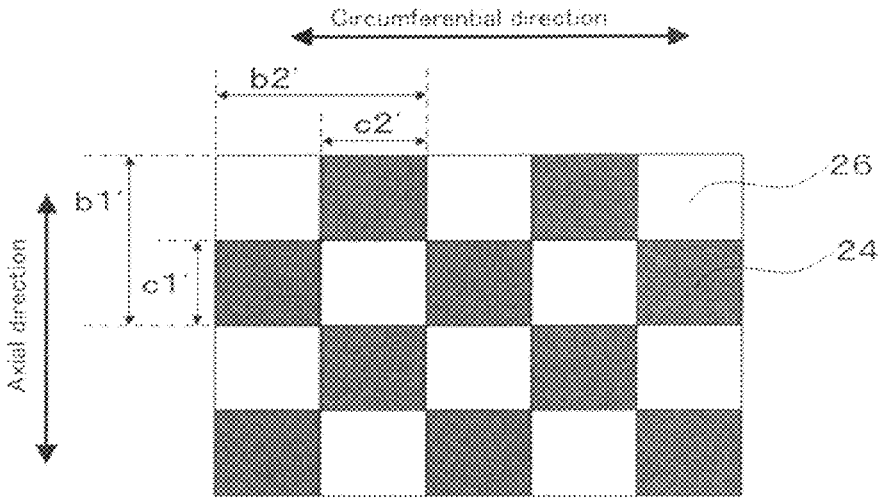
FIG. 8 is an enlarged view of a surface of a foam layer of the protecting agent supplying member illustrated in FIG. 6.

FIG. 8 is an enlarged view of the surface of the protecting agent supplying member of FIG. 6. In FIG. 8, concavities 26 are aligned into a lattice pattern (a checked pattern).

In FIG. 8, the distance (b1') between a couple of the concavities next to each other is a distance between two concavities next to each other in the axial direction of the protecting agent supplying member; the width (c1') of the foam layer present between a couple of the concavities next to each other is a width of the foam layer present in two concavities next to each other in the axial direction of the protecting agent supplying member; the distance (b2') between a couple of the concavities next to each other is a distance between two concavities next each other in the circumferential direction of the protecting agent supplying member; and the width (c2') of the foam layer present between a couple of the concavities next to each other is a width of the foam layer present in two concavities next each other in the circumferential direction of the protecting agent supplying member.

In the protecting agent supplying member, it is preferred that the concavities be substantially uniformly formed in the foam layer for preventing occurrences of filming on the entire surface of the image bearing member.

However, the foam layer may have a section where concavities are not formed therein at a part thereof, as long as the resulting foam layer does not impair the obtainable effect of the present invention. For example, the concavities may be formed, or may not be formed at the edge of the foam layer, which will be in contact with the edge of the image bearing member where a visible image (a toner image) is not formed with a toner.

A method for forming the concavities in the foam layer is appropriately selected depending on the intended purpose without any restriction, and examples thereof include a method of forming the concavities in the foam layer using a mold capable of forming the concavities in the outermost surface of the form layer during the molding of the foam layer, and a method for cutting off the outermost surface of the foam layer in the shape of a concavity to form the concavities in the foam layer.

Figure 4:
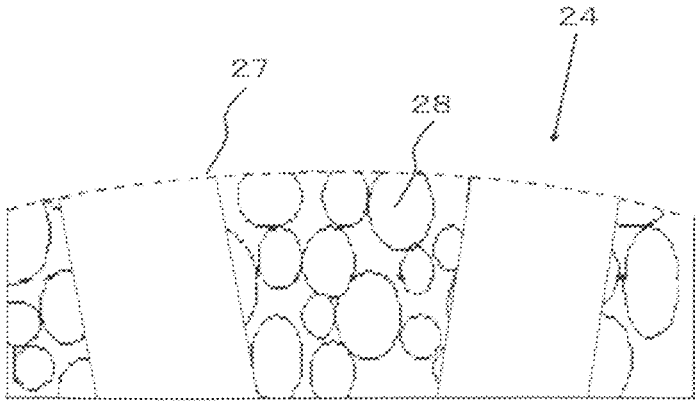
FIG. 4 is an enlarged cross-sectional view illustrating one example of a surface of a foam layer.

FIG. 4 is a cross-sectional enlarged view of the surface of the foam layer. As illustrated in FIG. 4, the foam layer has fine pores 28 inside of and in the surface thereof. Therefore, the concavities formed due to the irregularly aligned fine pores are present in the surface of the foam layer.

For measuring the various distances in the foam layer, the outermost surface of the foam layer is taken as a standard. The outermost surface is, as illustrated in FIG. 4, the outermost plane of the foam layer 24 in which the material constituting the foam layer 24 presents (exposed surface 27). Note that, for the bottom face of the concavity of the foam layer 24, the outermost plane of the foam layer 24 where the material constituting the foam layer 24 is present is used as a measurement standard. Moreover, for the internal perimeter surface of the foam layer 24, similarly to the outermost plane 27, the innermost plane where the material constituting the foam layer 24 is present is used as a standard for the measurement of the thickness of the foam layer.

A material of the foam layer is appropriately selected depending on the intended purpose without any restriction, and examples thereof include polyurethane foam.

Polyurethane Foam

The polyurethane foam is appropriately selected depending on the intended purpose without any restriction, and examples thereof include a polyurethane foam prepared by mixing at least polyol, polyisocyanate, a catalyst, and foaming agent, optionally further mixing other substances such as foam regulator therein, and allow the mixture to react.

Polyol

The polyol is appropriately selected depending on the intended purpose without any restriction, and examples thereof include polyether polyol, and polyester polyol. Among those listed above, polyether polyol is preferable, as it has desirable processing characteristics, and it is easy to control the hardness of the resulting foam layer.

The polyether polyol is, for example, polyether polyol prepared through open-ring addition polymerization of ethylene oxide, or propylene oxide, or both thereof with an initiator, which is low molecular polyol having 2 to 8 active hydrogen groups, or low molecular polyamine having 2 to 8 active hydrogen groups, or both thereof.

Moreover, the polyether polyol is, for example, selected from those commonly used in the production of flexible polyurethane foam, such as polyether polyether polyol, polyester polyether polyol, and polymer polyether polyol.

As the polyether polyol, polyether polyether polyol in which ethylene oxide is bound to the terminals thereof in the amount of 5 mol % or more is preferable, in view of formability.

Examples of the polyester polyol include: polyester polyol obtained through polymerization of dibasic acid or anhydride thereof (e.g. adipic acid, phthalic anhydride, isophthalic acid, terephthalic acid, and maleic anhydride) with glycol or triol (e.g. ethylene glycol, diethylene glycol, triethylene glycol, propylene glycol, dipropylene glycol, 1,4-butanediol, glycerin, and trimethylol propane).

As the polyester polyol, moreover, those obtained by depolymerization of a waste material of a polyethylene terephthalate resin with glycol listed above may also be used.

Those listed as the polyol above may be used independently, or in combination.

Polyisocyanate

The polyisocyanate is appropriately selected depending on the intended purpose without any restriction, and examples thereof include 2, 4-tolylenediisocyanate (2, 4-TDI), 2,6-tolylenediisocyanate (2,6-TDI), tolidinediisocyanate (TODI), naphthylene diisocyanate (NDI), xylylenediisocyanate (XDI), 4,4'-diphenylmethane diisocyanate (MDI), carbodiimide-modified MDI, polymethylene polyphenyl polyisocyanate, and polymeric polyisocyanate.

The polyisocyanate may be used independently, or in combination.

An amount of the polyisocyanate for use is appropriately selected depending on the intended purpose without any restriction, and it is, for example, determined as the equivalent ratio (NCO/OH) of the isocyanate groups of the polyisocyanate to the hydroxyl groups of the polyol, which is in the range of 1.0 to 3.0.

Catalyst

The catalyst is appropriately selected depending on the intended purpose without any restriction, and examples thereof include an amine-based catalyst, and an organic metal-based catalyst.

Examples of the amine-based catalyst include triethylene diamine, dimethyl ethanol amine, and bis(dimethylamino) ethyl ether.

Examples of the organic metal-based catalyst include dioctyl tin, and distearyl tin dibutylate.

The catalyst may be a reactive catalyst, such as dimethyl amino ethanol having an active hydrogen.

These may be used independently, or in combination.

An amount of the catalyst for use is appropriately selected depending on the intended purpose without any restriction, and it is, for example, 0.01 parts by mass to 20 parts by mass relative to 100 parts by mass of the polyol.

Foaming Agent

The foaming agent is appropriately selected depending on the intended purpose without any restriction, and examples thereof include water, a fluorocarbon compound, and a low boiling point hydrocarbon compound.

Examples of the fluorocarbon compound include HCFC-141b, HFC-134a, HFC-245fa, and HFC-365mfc.

Examples of the low boiling point hydrocarbon compound include cyclopentane, n-pentane, iso-pentane, and n-butane.

As the foaming agent, these may be used independently, or in combination.

An amount of the foaming agent for use is appropriately selected depending on the intended purpose without any restriction, and it is, for example, 5 parts by mass to 50 parts by mass relative to 100 parts by mass of the polyol Foam Regulator The foam regulator is appropriately selected depending on the intended purpose without any restriction, and examples thereof include a silicone surfactant.

Examples of commercial products of the silicone surfactant include a dimethyl siloxane-based foam regulator (e.g., SRX-253 manufactured by Dow Corning Toray Co., Ltd., and F-122 manufactured by Shin-Etsu Chemical Co., Ltd.), and a polyether-modified dimethyl siloxane-based foam regulator (e.g. L-5309, and SZ-1311, both manufactured by Nippon Unicar Company Limited).

An amount of the foam regulator for use is appropriately selected depending on the intended purpose without any restriction, and it is, for example, 0.2 parts by mass to 10 parts by mass relative to 100 parts by mass of the polyol.

Other Substances

Examples of other substances include a crosslinking agent, defoaming agent, and the like for controlling the formation of isolated cells, or interconnected cells.

The crosslinking agent is appropriately selected depending on the intended purpose without any restriction, and examples thereof include triethanol amine, and diethanol amine.

The defoaming agent is appropriately selected depending on the intended purpose without any restriction, and examples thereof include foam regulators having the high defoaming ability among those mentioned above as the foam regulator.

For the production of the polyurethane foam, the method generally used is a method in which raw materials of the polyurethane foam excluding the polyisocyanate are premixed, and the resulting mixture is mixed with the polyisocyanate just before molding.

The shape of the foam layer is appropriately selected depending on the intended purpose without any restriction, and it is, for example, a cylindrical shape.

The average thickness of the foam layer is appropriately selected depending on the intended purpose without any restriction. The average thickness thereof is preferably 1 mm to 5 mm for downsizing and reducing the weight of the resulting device.

In the case where the foam layer is in the cylindrical shape, a distance (A) between the internal perimeter surface of the cylindrical and the outer surface thereof is determined as a thickness, as illustrated in FIG. 3.

In the present specification, the average thickness is the average value of the values in the thickness of the foam layer measured at randomly selected 5 spots therein.

The structure of the foam layer is appropriately selected depending on the intended purpose without any restriction, and examples thereof include a structure containing isolated cells, and a structure containing interconnected cells. Among them, the structure containing interconnected cell is preferable, because the foam layer of such structure has small residual strain from compression, and therefore the foam layer is easily returned into the original shape after compressed, and hardly deforms after use of a long period of time.

Figure 9:
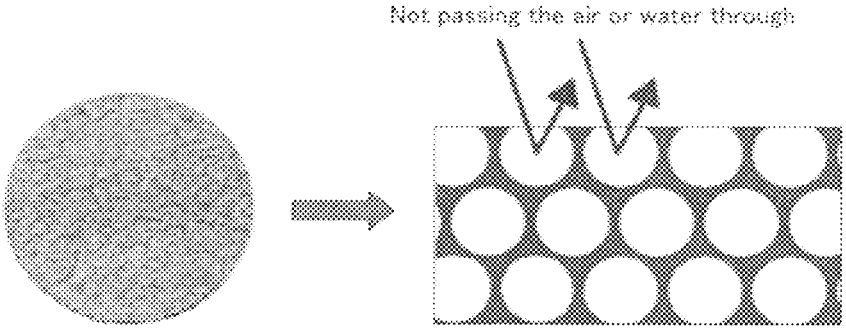
FIG. 9 is a schematic cross-sectional view illustrating an example of a foam layer of an isolated cell structure.

Note that, the foam layer of the isolated cell structure is a foam layer having the structure which has isolated pores (may also referred to as "cells") and does not allow air or water to go through, as illustrated in FIG. 9.

Figure 10:
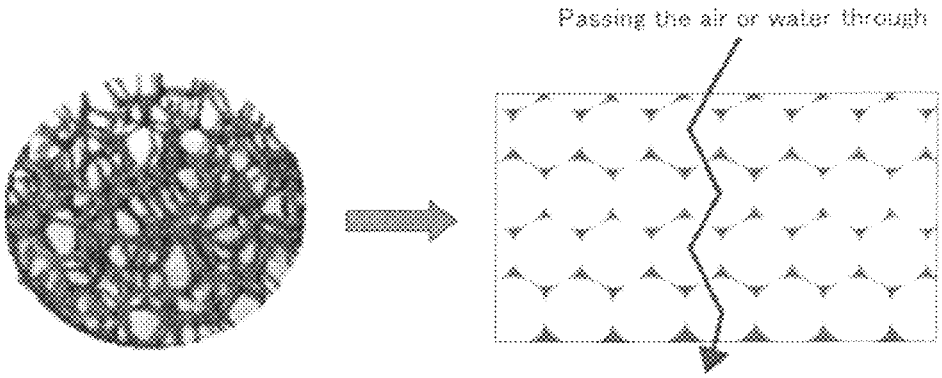
FIG. 10 is a schematic cross-sectional view illustrating an example of a foam layer of an interconnected cell structure.

The foam layer of the interconnected cell structure is a foam layer having a structure in which adjacent cells are connected to each other, and allows air or water to go through, as illustrated in FIG. 10.

The number of cells in the foam layer is appropriately selected depending on the intended purpose without any restriction, but it is preferably 25 per inch to 300 per inch, more preferably 50 per inch to 150 per inch. When the number of the cells is less than 25 per inch, it may be difficult to prevent filming on the image bearing member. When the number thereof is more than 300 per inch, it may be also difficult to prevent filming on the image bearing member. When the number of the cells is within the preferable range mentioned above, conversely, it is advantageous because the resulting protective agent supplying member is excellent in preventing filming of the image bearing member.

The number of the cells is the average value measured by the following method.

Figure 11A:
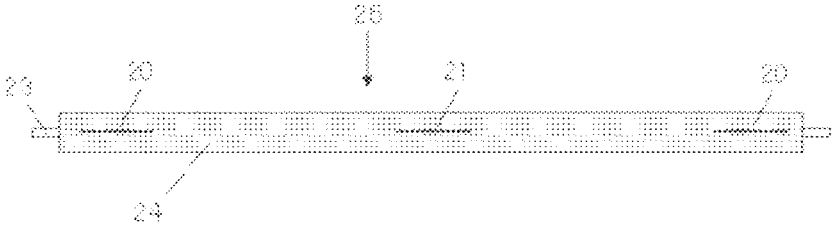
FIG. 11A is a front view of an example of a protecting agent supplying member.
Figure 11B:
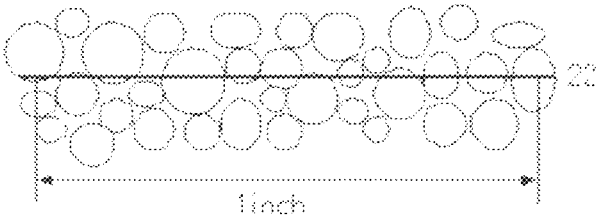
FIG. 11B is an enlarged view illustrating an example of a foam layer of a protecting agent supplying member.

Three spots (20, and 21 in FIG. 11A) are randomly selected as the measuring spots on the surface of the foam layer, and the three spots are respectively in the parts near the edges, and in the central part of the foam layer with respect to the axial direction of the protecting agent supplying member. Note that, FIG. 11A is a front view of the protecting agent supplying member. The protecting agent supplying member 25 has a foam layer 24 at the periphery of the core 23. In FIG. 11A, 20 represents the measuring spots in the edges, and 21 represents the measuring spot in the central part. Next, in each measuring spot, two spots (not shown in FIG. 11A) are further selected in the circumferential direction, so that 9 spots were selected as the measuring spots, in total. Then, a photographic image of each measuring spot was observed by a microscope. As illustrated in FIG. 11B a line 22 of the length (approximately 25 mm) corresponding to 1 inch in the full size is drawn in the center part of the photographic image, and the number of cells present along the line is counted, and the average value of the values obtained from the 9 measuring spots are obtained. Note that, a cell which was in contact with the 1-inch line 22, even at the slightest degree, is counted as one. In the case of FIG. 11B, for example, the number of cells is 12.

The hardness of the foam layer is appropriately selected depending on the intended purpose without any restriction, but it is preferably 50 N to 500 N, more preferably 100 N to 300 N. When the hardness thereof is less than 50 N, it may be difficult to prevent filming of the image bearing member. When the hardness thereof is more than 500 N, it may be also difficult to prevent filming of the image bearing member. When the hardness thereof is within the more preferable range mentioned above, it is advantageous because an excellent effect of preventing filming of the image bearing member can be attained.

The hardness is the average value of values obtained by measuring the hardness at randomly selected 3 spots on the surface of the foam layer in accordance with the method specified in JIS K 6400.

The structures of the foam layer, such as the isolated cell structure, and the interconnected cell structure, the number of cells in the foam layer, and the hardness of the foam layer can be controlled by appropriately adjusting a raw material of polyurethane form for use, an amount of a foaming agent for use, and reaction conditions during the production of the polyurethane foam.

The production method of the protecting agent supplying member is appropriately selected depending on the intended purpose without any restriction.

As one example of the production method of the protecting agent supplying member, a production example where the polyurethane foam is used as a material for the foam layer will be explained hereinafter.

At first, raw materials of polyurethane foam are foamed, and set by any of the conventional methods to form polyurethane foam in the shape of a block. The block-shaped polyurethane foam is cut into the predetermined shape, surfaces thereof are polished, and it is processed into a cylinder-shaped polyurethane foam having open-cells on the surface thereof. Thereafter, the core is inserted into the inner portion of the cylindrical. An adhesive may be applied to the core to enhance the adhesion to the foam layer. Thereafter, concavities are formed by cutting out the surface of the foam layer formed of the polyurethane form by means of a grinder or cutter capable of fine processing. In the manner as mentioned, the protecting agent supplying member is produced.

Another production example of the protecting agent supplying member will be explained hereinafter.

Raw materials of polyurethane foam are poured into a mold for a protecting supplying member, in which a core is placed, and then the raw materials of the polyurethane foam is foamed and cured. In order to form concavities in a surface of a foam layer during the curing, convex parts are formed on the surface of the mold where the polyurethane foam will be in contact with. In the manner as mentioned, the protecting agent supplying member is produced.

In the production method using the mold, it is preferred that a releasing layer of a fluororesin coating agent or a releasing agent be provided on the inner surface of the mold for forming the foam layer having the desirable porosity without any complicated process.

Protective Layer Forming Device

The protective layer forming device of the present invention contains at least a protecting agent block, and a protecting agent supplying member, and may further contain other members, such as a pressing force applying member, and a protective layer forming member, if necessary.

Protecting Agent Block

The protecting agent block is appropriately selected depending on the intended purpose without any restriction, and examples thereof include a protecting agent block containing at least a fatty acid metal salt, and optionally containing other substances such as an inorganic lubricant.

Fatty Acid Metal Salt

The fatty acid metal salt is appropriately selected depending on the intended purpose without any restriction, and examples thereof include metal stearate, metal oleate, metal palmitate, metal caprylate, metal linolenate, and metal ricinoleate.

Examples of the metal stearate include barium stearate, lead stearate, iron stearate, nickel stearate, cobalt stearate, copper stearate, strontium stearate, calcium stearate, cadmium stearate, magnesium stearate, and zinc stearate.

Examples of the metal oleate include zinc oleate, magnesium oleate, iron oleate, cobalt oleate, copper oleate, lead oleate, and manganese oleate.

Examples of the metal palmitate include zinc palmitate, cobalt palmitate, lead palmitate, magnesium palmitate, aluminum palmitate, and calcium palmitate.

Examples of the metal caprylate include lead caprylate.

Examples of the metal linolenate include zinc linolenate, cobalt linolenate, and calcium linolenate.

Examples of the metal ricinoleate include zinc ricinoleate, and cadmium ricinoleate.

Among them, in view of the excellent inhibiting ability for filming of an image bearing member, the metal stearate is preferable, and zinc stearate is more preferable.

Those listed above as the fatty acid metal salt may be used independently, or in combination.

Inorganic Lubricant

The protecting agent block preferably contains an inorganic lubricant for preventing contaminations of a charging member.

The inorganic lubricant is appropriately selected depending on the intended purpose without any restriction, and examples thereof include mica, boron nitride, molybdenum disulfide, tungsten disulfide, talc, kaolin, montmorillonite, calcium fluoride and graphite.

Among them, boron nitride is preferable, because it has excellent inhibiting ability of contaminations of a charging member.

Those listed above as the inorganic lubricant may be used independently, or in combination.

The formulating ratio of the fatty acid metal salt and the inorganic lubricant (fatty acid metal salt/inorganic lubricant (mass basis)) in the protecting agent block is appropriately selected depending on the intended purpose without any restriction, but it is preferably 100/0 to 50/50, more preferably 95/5 to 60/40. When the fatty acid metal salt is smaller than 50/50 in the formulating ratio, it may be difficult to form a protective layer on an image bearing member. Conversely, when the formulating ratio is within the more preferable range, it is advantageous because filming of an image bearing member and contaminations of a charging member are excellently prevented.

The size and shape of the protecting agent block are appropriately selected depending on the intended purpose without any restriction, but the shape thereof is, for example, a bar shape.

Examples of the bar shape include a shape of quadrangular prism, and a column shape.

The method of forming the protecting agent block is appropriately selected depending on the intended purpose without any restriction, and examples thereof include compression, and fusion molding.

Compression

The method of the compression is appropriately selected depending on the intended purpose without any restriction. One example of the method of the compression will be explained with reference to the drawings hereinafter.

Figure 12:
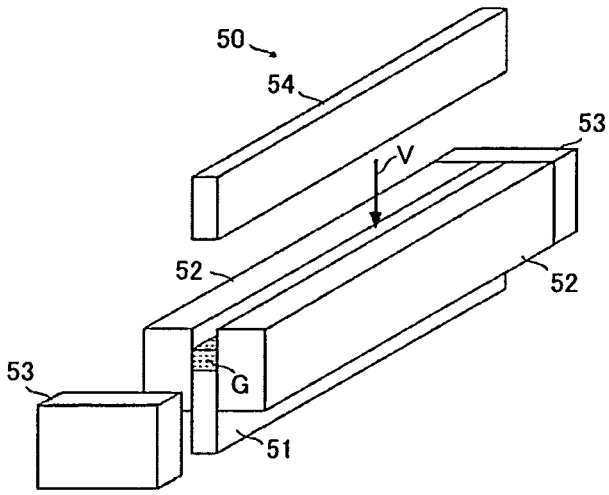
FIG. 12 is a perspective view explaining a process of forming a protective agent block by compression using a protecting agent block production device.
Figure 13:
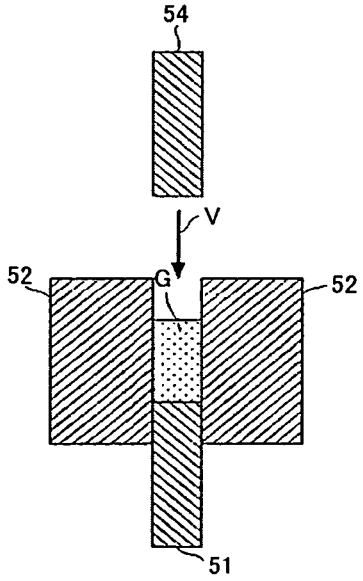
FIG. 13 is a sectional side elevation of the production device illustrated in FIG. 12.

FIG. 12 is a perspective view illustrating the process of forming the protecting agent block by compression by means of an apparatus for forming a protecting agent block. FIG. 13 is a sectional side elevation of the apparatus of FIG. 12.

As illustrated in FIGS. 12 and 13, the apparatus for forming a protecting agent block 50 has a lower die 51, a pair of side dies 52 arranged to sandwich the lower die 51 and providing side planes of the protecting agent block extending in the length direction, a pair of edge dies 53 arranged to sandwich the lower die 51 and the side dies 52 and providing edge planes of the protecting agent block with respect to the length direction, and an upper die 54.

In FIG. 12, one of the edge dies 53 shows the state where it is decomposed, but it is actually present in the position corresponding to the other edge die 53, and at the time of the compressing the protecting agent block, these edge dies 53, lower die 51, and side dies 52 form a partially confined space that opens in the direction in which the upper die 54 enters. Moreover, once the upper die 54 is moved in the direction shown with the arrow V in FIGS. 12 and 13 to introduce the upper die 54 into the confined space, a completely confined space is formed with the lower die 51, side dies 52, edge dies 53, and upper die 54.

A powder G, which is a raw material of the protecting agent block, is filled in the spate formed in the state where the upper die 54 is taken off. The powder G may be in the form of a powder, or granules, or a combination thereof.

Once the charging of the powder G is completed, the upper die 54 is introduced into the partially confined space in the direction shown with V, pressing is performed while forming a completely confined space, to thereby form a protecting agent block.

Figure 14:
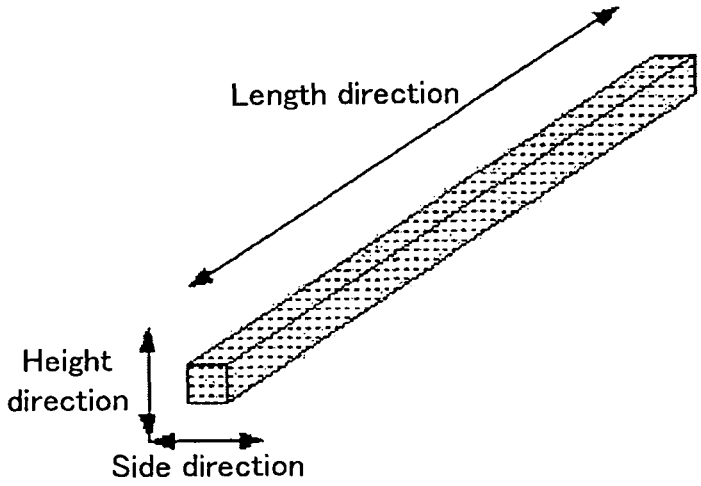
FIG. 14 is a diagram illustrating one example of a shape of the protecting agent block.

In the manner mentioned above, the protecting agent block in the shape of a quadrangular prism as shown in FIG. 14 is produced by the compression.

Note that, the protecting agent block formed by the fusion molding is translucent and the protecting agent black formed by the compression is white in color, and therefore these can be visually distinguished.

Protecting Agent Supplying Member

The protecting agent supplying member is the protecting agent supplying member of the present invention, configured to scrape the protecting agent off from the protecting agent block and to supply the protecting agent to the surface of the image bearing member.

Pressing Force Applying Member

The pressing force applying member is appropriately selected depending on the intended purpose without any restriction, provided that it is a member configured to press the protecting agent block to bring the protecting agent block into contact with the protecting agent supplying member, and examples thereof include a pressure spring.

Protective Layer Forming Member

The protective layer forming member is appropriately selected depending on the intended purpose without any restriction, provided that it is capable of thinly leveling the protecting agent supplied on the surface of the image bearing member to thereby form a protective layer, and examples thereof include a blade.

A material of the blade is appropriately selected depending on the intended purpose without any restriction, and examples thereof include urethane rubber, epichlorhydrin rubber, silicone rubber, and fluorine-containing rubber.

These may be used independently, or in combination.

A contact area of the blade mentioned above with the image bearing member may be coated with a low friction coefficient material by coating or impregnation. Moreover, fillers such as organic filler and inorganic filler may be dispersed in the blade to adjust the hardness of the blade.

The blade is fixed to a blade support by any method such as adhesion or fusion, so that an edge of the blade can be pressed against and in contact with the surface of the image bearing member. The thickness of the blade cannot be easily regulated because it varies depending on the pressure applied for compression, but it is preferably 0.5 mm to 5 mm, more preferably 1 mm to 3 mm.

Moreover, the length of the blade which allows the blade to stick out from the blade support and to bend, namely, the free length of the blade, is not easily regulated because it varies depending on the pressure applied for compression, but it is preferably 1 mm to 15 mm, more preferably 2 mm to 10 mm.

Another structure of the protective layer forming member include is the one in which a coating layer of a resin, rubber, elastomer, or the like is formed on a surface of a resilient metal such as a spring leaf by a method such as coating, and dipping, directly, or if necessary with assistance of a coupling agent or primer substance in between, and optionally it is processed for thermally curing the coating layer, and further optionally it is subjected to surface polishing.

The coating layer contains at least a binder resin and filler, and may further contain other substances, if necessary.

The binder resin is appropriately selected depending on the intended purpose without any restriction, and examples thereof include a fluororesin, such as perfluoroalkoxyalkane (PFA), polytetrafluoroethylene (PTFE), a tetrafluoroethylene-hexafluoropropylene copolymer (FEP), and polyvinylidene fluoride (PVdF); fluororubber; and silicone elastomer such as methylphenyl silicone elastomer.

The thickness of the resilient metal blade is appropriately selected depending on the intended purpose without any restriction, but it is preferably 0.05 mm to 3 mm, more preferably 0.1 mm to 1 mm. The resilient metal blade may be subjected to a bending process in the direction substantially horizontal to the spindle after mounting so as to prevent torsion of the blade.

As the force for pressing the image bearing member with the protective layer forming member, the force that can spread the protecting agent to form into a protective layer is sufficient, and when it is determined as a linear pressure, the force is preferably 5 gf/cm to 80 gf/cm, more preferably 10 gf/cm to 60 gf/cm.

The protective layer forming member can be also functioned as a cleaning member. For forming a protective layer more reliably, it is preferred that the residuals containing the toner as a main component remained on the image bearing member be removed by the cleaning member in advance so that the residuals are not mixed in the protective layer.

Figure 15:
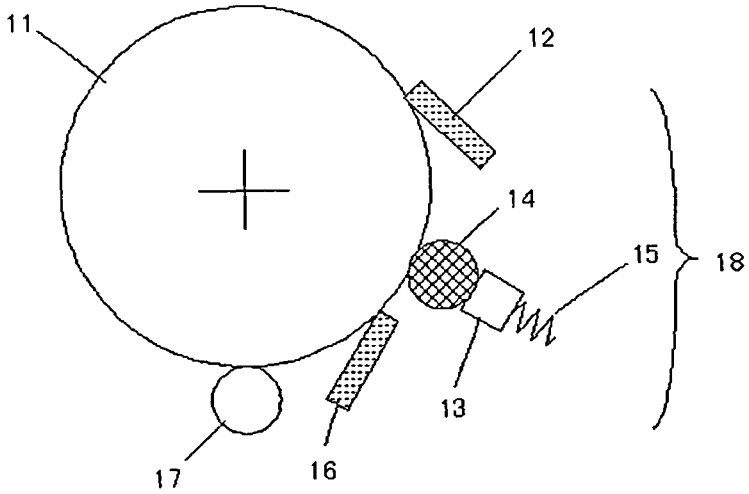
FIG. 15 is a schematic cross-sectional view illustrating one example of the protective layer forming device of the present invention.

The protective layer forming device will be explained with reference to the drawing hereinafter. FIG. 15 is a schematic cross-sectional view illustrating one example of the protective layer forming device of the present invention.

The protective layer forming device 18, which is provided to face the photoconductor drum 11 serving as the image bearing member, mainly contains a protecting agent block 13, a protecting agent supplying member 14, a pressing force applying member 15, a protective layer forming member 16, and the like.

The protecting agent block 13 is brought into contact with the roller shaped protecting agent supplying member 14 by the pressing force of the pressing force applying member 15. The protecting agent supplying member 14 rotates at the linear velocity with the difference with that of the photoconductor drum 11, and abraded by the photoconductor drum 11. During this rotation and abrasion of the protecting agent supplying member 14, the protecting agent held by the surface of the protecting agent supplying member is supplied to the surface of the image bearing member.

Note that there are cases where the protecting agent supplied to the surface of the image bearing member may not sufficiently formed into a protective layer depending on selected materials for use. In order to form a protective layer more uniformly, the protecting agent is formed into a thin layer, for example, by the protective layer forming member 16 having a blade-shaped member, to thereby form a protective layer.

The charging roller 17, to which direct current voltage, or the voltage where alternating voltage is superimposed to the direct current voltage is applied, for example, by the high voltage power source (not illustrated), is brought into contact with, or approached to the vicinity of the image bearing member to which the protective layer has been formed, to thereby perform charging of the image bearing member by discharged in the mocrocavities. During the charging, the protective layer is partly decomposed, or oxidized by the electrical stress, and corona products in the air are deposited onto the surface of the protective layer.

Note that, the deteriorated protecting agent for the image bearing member is a common cleaning unit together with the components such as the toner remained on the image bearing member. Such cleaning unit may also function as the protective layer forming member 16 mentioned above. However, there are cases where a suitable abrasion state of the member may be different for the function of removing the residuals on the surface of the image bearing member, and for the function of forming a protective layer. Therefore, it is preferred that these functions be separated, and a cleaning unit containing a cleaning member 12, a cleaning pressing force applying unit (not illustrated) and the like be provided at the upstream of the protecting agent supplying member, as illustrated in FIG. 15.

Image Forming Method and Image Forming Apparatus

The image forming method contains at least a latent electrostatic image forming step, developing step, a transferring step, a protective layer forming step, and a fixing step, preferably further contains a cleaning step, and may further contain other steps, such as a diselectrification step, a recycling step, and a controlling step, if necessary.

The image forming apparatus of the present invention contains at least an image bearing member, a latent electrostatic image forming unit, a developing unit, a transferring unit, a protective layer forming unit, and a fixing unit, preferably further contains a cleaning unit, and may further contain arbitrarily selected other units, such as a diselectrification unit, a recycling unit, and a controlling unit, if necessary.

The image forming method described here can be suitably performed by the image forming apparatus of the present invention; the latent electrostatic image forming step can be performed by the latent electrostatic image forming unit; the developing step can be performed by the developing unit; the transferring step can be performed by the transferring unit; the protective layer forming step can be performed by the protective layer forming unit; the fixing step can be performed by the fixing unit; and other steps mentioned above can be performed by other units mentioned above.

Latent Electrostatic Image Forming Step and Latent Electrostatic Image Forming Unit The latent electrostatic image forming step is forming a latent electrostatic image on an image bearing member.

Image Bearing Member

A material, shape, structure, size and the like of the image bearing member (may also referred to as "a photoconductor" in this specification) are appropriately selected from those known in the art without any restriction, but examples of the preferable shape of the image bearing member include a drum shape, examples of the material thereof include: an inorganic semiconductor such as amorphous silicon and selenium; and an organic semiconductor such as polysilane, and phthalopolymethine.

The image bearing member (photoconductor) for use in the image forming apparatus of the present invention contains a conductive support, and at least a photosensitive layer provided on the conductive support, and may further contain other layers, if necessary.

As the photosensitive layer, there are a single-layer photosensitive layer in which charge-generating material coexists with a charge transporting material, a sequential laminate photosensitive layer, in which a charge transporting layer is provided over a charge generating layer, and a reverse laminate photosensitive layer in which a charge generating layer is provided over a charge transporting layer. Moreover, an outermost layer may be provided over the photosensitive layer for improving the physical strength, abrasion resistance, antigas properties, cleaning ability, and the like of the photoconductor. Furthermore, an undercoat layer may be provided between the photosensitive layer and the conductive support. In addition, an appropriate amount of a plasticizer, antioxidant, leveling agent, or the like may be added to each layer, if necessary.

The conductive support is appropriately selected depending on the intended purpose without any restriction, provided that it has a volume resistivity of $1.0\times10^{10}$ Ω·cm or lower, and examples thereof include: a film-shaped or cylindrical plastic or paper coated with a metal (e.g. aluminum, nickel, chromium, nichrome, copper, gold, silver, platinum) or a metal oxide (e.g. tin oxide, indium oxide) by vacuum deposition or sputtering; and a tube which is formed by forming one or more plates of aluminum, aluminum alloy, nickel, stainless steel into a tube by extrusion, or drawing out, then subjecting the tube to surface treatment such as cutting, super-finishing, and polishing.

The drum-shaped support preferably has a diameter of 20 mm to 150 mm, more preferably 24 mm to 100 mm, and even more preferably 28 mm to 70 mm. When the diameter of the drum-shaped support is smaller than 20 mm, it may be physically difficult to arrange units used for the steps of charging, exposing, developing, transferring, and cleaning at the periphery of the drum-shaped support. When the diameter thereof is larger than 150 mm, a size of a resulting image forming apparatus may be undesirably large. Especially when an image forming apparatus is of a tandem system, a few photoconductors are mounted therein. For this reason, the diameter of the drum-shaped support is preferably 70 mm or smaller, more preferably 60 mm or smaller. Moreover, an endless nickel belt as disclosed in JP-A No. 52-36016, or an endless stainless steel belt can also be used as the conductive support.

The undercoat layer of the photosensitive layer may be of a single layer, or a laminate of two or more layers, and examples thereof include (1) a photosensitive layer mainly formed of a resin, (2) a photosensitive layer mainly formed of a white pigment and a resin, and (3) a photosensitive layer that is a metal oxide film in which a surface of a conductive substrate is chemically or electrochemically oxidized. Among them, the photosensitive layer mainly formed of the white pigment and the resin is preferable.

Examples of the white pigment include metal oxide such as titanium oxide, aluminum oxide, zirconium oxide, and zinc oxide. Among them, titanium oxide is particularly preferable as the white pigment for use, because it has an excellent ability of preventing charge injections from the conductive support.

Examples of the resin include: a thermoplastic resin such as polyamide, polyvinyl alcohol, casein, and methyl cellulose; and a thermoset resin such as an acryl resin, a phenol resin, a melamine resin, an alkyd resin, an unsaturated polyester resin, and an epoxy resin. These may be used independently, or in combination.

A thickness of the undercoat layer is appropriately selected depending on the intended purpose without any restriction, and it is preferably 0.1 μm to 10 μm, more preferably 1 μm to 5 μm.

Examples of the charge generating material for use in the photosensitive layer include: an azo pigment such as a monoazo pigment, a bisazo pigment, a trisazo pigment, and a tetrakisazo pigment; an organic pigment or dye, such as a triarylmethane dye, a thiazine dye, an oxazine dye, a xanthene dye, a cyanine dye, a styryl coloring agent, a pyrylium dye, a quinacridon pigment, an indigo pigment, a perylene pigment, a polycyclic quinone pigment, a bisbenzoimidazole pigment, an indathrene pigment, a squarylium pigment, and a phthalocyanine pigment; and an inorganic material such as selenium, selenium-arsenic, selenium-tellurium, cadmium sulfide, zinc oxide, titanium oxide, and amorphous silicon. These may be used independently, or in combination.

Examples of the charge transporting material for use in the photosensitive layer include an anthracene derivative, a pyrene derivative, a carbazole derivative, a tetrazole derivative, a metallocene derivative, a phenothiazine derivative, a pyrazoline compound, a hydrazone compound, a styryl compound, a styrylhydrazone compound, an enamine compound, a butadiene compound, a distyryl compound, an oxazole compound, an oxadiazole compound, a thiazole compound, an imidazole compound, a triphenylamine derivative, a phenylene diamine derivative, an aminostilbene derivative, and a triphenyl methane derivative. These may be used independently, or in combination.

As a binder resin used for forming the photosensitive layer, a thermoplastic resin, a thermoset resin, a photocuring resin, and a photoconductive resin, and the like known in the art, which is electrically insulating, can be used. Examples of the binder resin include: a thermoplastic resin such as polyvinyl chloride, polyvinylidene chloride, a vinyl chloride-vinyl acetate copolymer, a vinyl chloride-vinyl acetate-maleic anhydride copolymer, an ethylene-vinyl acetate copolymer, polyvinyl butyral, polyvinyl acetal, polyester, phenoxy resin, (meth)acryl resin, polystyrene, polycarbonate, polyacrylate, polysulfone, polyether sulfone, and ABS resin; a thermoset resin such as a phenol resin, an epoxy resin, a urethane resin, a melamine resin, an isocyanate resin, an alkyd resin, a silicone resin, and a thermoset acryl resin; and others such as polyvinyl carbazole, polyvinylanthracene, and polyvinyl pyrene. These may be used independently, or in combination.

The outermost layer of the photoconductor is provided for improving the physical strength, abrasion resistance, anti-gas properties, cleaning ability, and the like of the photoconductor. The outermost layer is preferably the one in which inorganic filler is dispersed in a polymer having higher physical strength than that of the photosensitive layer. The resin for use in the outermost layer may be a thermoplastic resin or a thermoset resin, but the thermoset resin is particularly preferable because it has high physical strength, and extremely high ability of preventing abrasion caused by friction with a cleaning blade, or the like. As long as the thickness of the outermost layer is thin, the outermost layer has no problem even though it does not have charge transporting properties. However, if the thick outermost layer does not have charge transporting properties, the resulting photoconductor tends to have low sensitivity, potential increase after exposure, and residual potential increase. Therefore, it is preferred that the aforementioned charge transporting material be contained in the outermost layer, or a polymer having charge transporting properties be used in the outermost layer.

Since the mechanical strength of the photosensitive layer and that of the outermost layer are generally largely different, the photosensitive layer is soon abraded once the outermost layer is abraded and lost from the frictions with a cleaning blade. For this reason, it is important that a sufficient thickness of the outermost layer is secured in the case where the outermost layer is provided in the photoconductor, and the thickness thereof is preferably 0.1 μm to 12 μm, more preferably 1 μm to 10 μm, and even more preferably 2 μm to 8 μm. When the thickness thereof is less than 0.1 μm, the outermost layer is so thin that it tends to be partially lost due to the frictions with a cleaning blade, and the photosensitive layer exposed from the area where the outermost layer has been lost tends to be abraded. When the thickness thereof is more than 12 μm, the reduction in the sensitivity, increase in the potential after the exposure, and the increase in the residual potential tend to occur, and especially in the case where a polymer having charge transporting properties is used to solve these drawbacks, the cost required for the polymer having charge transporting properties used therein is high.

The resin used for the outermost layer is preferably selected from those transparent to light used for writing at the time of image formation, and having excellent insulation properties, mechanical strength, and adhesion, and examples of such resin include an ABS resin, an ACS resin, an olefin-vinyl monomer copolymer, polyether chloride, a phenol resin, polyacetal, polyamide, polyamide imide, polyacrylate, polyallyl sulfone, polybutylene, polybutylene terephthalate, polycarbonate, polyether sulfone, polyethylene, polyethylene terephthalate, polyimide, a polyacrylic resin, polymethyl pentene, polypropylene, polyphenylene oxide, polysulfone, polystyrene, an AS resin, a butadiene-styrene copolymer, polyurethane, polyvinyl chloride, polyvinylidene chloride, and an epoxy resin. These polymer may be thermoplastic, but use of a thermoset resin crosslinked by a crosslinking agent containing polyfunctional acryloyl groups, carboxyl groups, hydroxyl groups, amino groups, or the like for enhance the mechanical strength of the polymer can increase the mechanical strength of the outermost layer, and significantly reduce abrasion caused by the frictions with a cleaning blade.

The outermost layer preferably has charge transporting properties. To provide the outermost layer with the charge transporting properties, there are a method of using a polymer and the aforementioned charge transporting material in combination in the outermost layer, and a method of using a polymer having charge transporting properties in the outermost layer. The latter method is preferable because a resulting photoconductor has high sensitivity, and suppressed potential increase after the exposure, and residual potential increase.

To enhance the mechanical strength of the outermost layer, it is preferred that metal particles, metal oxide particles, or other particles be contained in the outermost layer. Examples of the metal oxide include titanium oxide, tin oxide, potassium titanate, titanium nitride, zinc oxide, indium oxide, and antimony oxide. Examples of other particles include particles in each of which an inorganic material is dispersed in a resin such as a fluororesin (e.g. polytetrafluoroethylene), a silicone resin, and a combination thereof, for the purpose of improving abrasion resistance.

The formation of the latent electrostatic image can be performed, for example, by after charging the surface of the image bearing member, exposing the surface of the image bearing member to light in an imagewise manner, and can be performed by the latent electrostatic image forming unit. The latent electrostatic image forming unit is, for example, equipped with a charger configured to charge a surface of the image bearing member, and an exposing unit configured to apply to the surface of the image bearing member imagewise to thereby expose the surface of the image bearing member.

The charging is performed, for example, by applying a voltage to a surface of the image bearing member using the charger.

The charger is appropriately selected depending on the intended purpose without any restriction, and examples thereof include a conventional contact charger equipped with conductive or semiconductive roller, brush, film, rubber blade, or the like, and a conventional non-contact charger using corona discharge such as corotron and scorotron.

As the charger, the one having a voltage applying unit configured to apply a voltage including alternating current.

The exposing is performed, for example, by applying light to a surface of the image bearing member imagewise by means of the exposing unit to thereby expose the surface of the image bearing member.

The exposing unit is appropriately selected depending on the intended purpose without any restriction, provided that it is capable of exposing the charged surface of the image bearing member by the charging unit to light imagewise, and examples thereof include various exposing devices such as a reproduction optical exposing device, a rod-lens array exposing device, a laser optical exposure device, and a liquid crystal shutter optical device.

Note that, a photo-image black irradiation electrophotographic system in which exposure is performed imagewise from the back surface of the image bearing member may be applied for the exposure.

Developing Step and Developing Unit

The developing step is developing the latent electrostatic image with a toner or a developer to form a visible image.

The formation of the visible image can be performed, for example, by developing the latent electrostatic image with the toner or the developer, and it can be performed by the developing unit.

The developing unit is appropriately selected from those known in the art without any restriction, provided that it is capable of performing developing using the toner or the developer, and examples thereof include a developing unit housing the toner or developer therein, and capable of applying the toner or developer to the latent electrostatic image in a contact or non-contact manner.

Toner

The toner is appropriately selected depending on the intended purpose without any restriction, and it is, for example, a toner produced by allowing a toner composition, which contains a polyester prepolymer containing a functional group containing a nitrogen atom, a compound elongated or crosslinked with the prepolymer, polyester, a colorant, and a releasing agent, to proceed to a crosslink and/or elongation reaction in an aqueous medium in the presence of resin particles. By hardening a surface of each particle of this toner, occurrences of hot offset can be reduced in the use of the toner.

Examples of the polyester prepolymer containing a functional group containing a nitrogen atom include a polyester prepolymer having an isocyanate group. Examples of the compound to be elongated or crosslinked with the prepolymer include amines.

Examples of the polyester prepolymer containing the isocyanate include a reaction product obtained by reacting polyester having an active hydrogen group, which is a condensate product of polyol and polycarboxylic acid, with polyisocyanate. Examples of the active hydrogen group contained in the polyester include a hydroxyl group (e.g., an alcoholic hydroxyl group, and a phenolic hydroxyl group), an amino group, a carboxyl group, and a mercapto group. Among them, the alcoholic hydroxyl group is particularly preferable.

The polyol is appropriately selected depending on the intended purpose without any restriction, and examples thereof include diol, and trihydric or higher polyol. Among them, diol alone, or a combination of the diol and a small amount of the trihydric or higher polyol is preferable.

The polycarboxylic acid is appropriately selected depending on the intended purpose without any restriction, and examples thereof include dicarboxylic acid, and tri- or higher valent polycarboxylic acid. Among them, dicarboxylic acid alone, or a combination of the dicarboxylic acid and a small amount of the tri- or higher polycarboxylic acid is preferable.

A ratio of the polyol and the polycarboxylic acid is determined as an equivalent ratio [OH]/[COOH] of the hydroxyl groups [OH] to the carboxyl groups [COOH], and the equivalent ratio is preferably 2/1 to 1/1, more preferably 1.5/1 to 1/1, and even more preferably 1.3/1 to 1.02/1.

Examples of the polyisocyanate include: aliphatic polyisocyanate (e.g., tetramethylene diisocyanate, hexamethylene diisocyanate, and 2,6-diisocyanate methyl caproate); alicyclic polyisocyanate isophorone diisocyanate, and cyclohexylmehane diisocyanate); aromatic diisocyanate (e.g., tolylene diisocyanate, and diphenylmethane diisocyanate); aromatic aliphatic isocyanate $\alpha,\alpha,\alpha',\alpha'$-tetramethyl xylylene diisocyanate); isocyanirates; and these polyisocyanates blocked with phenol derivatives, oxime, caprolactam, or the like. These may be used independently, or in combination.

The ratio of the polyisocyanate is determined as an equivalent ratio [NCO]/[OH] of the isocyanate groups [NCO] in the polyisocyanate and the hydroxyl groups [OH] in the polyester containing a hydroxyl group, and the equivalent ratio is preferably 5/1 to 1/1, more preferably 4/1 to 1.2/1, and even more preferably 2.5/1 to 1.5/1. When the ratio [NCO]/[OH] is larger than 5/1, the toner may have a poor low temperature fixing ability. When the molar ratio of [NCO] is less than 1, a urea content in the resulting modified polyester is low, which leads to poor hot offset resistance of the toner.

Examples of the amines include divalent amine, tri or higher valent amine, amino alcohol, amino mercaptan, amino acid, and these amines in which amino groups are blocked. Among these amines, the divalent amine, or a mixture of the divalent amine and a small amount of the tri or higher valent amine is preferable.

Furthermore, a molecular weight of the urea-modified polyester can be controlled with an elongation terminator, if necessary. Examples of the elongation terminator include monoamine (e.g., diethyl amine, dibutyl amine, butyl amine, and lauryl amine), and blocked products thereof (e.g. a ketimine compound).

Other than the aforementioned polymerization toner whose structure is suited for attaining high quality images, an irregularly shaped toner obtained through pulverization can be also used in the image forming method and the image forming apparatus. In the case where the toner obtained by the pulverization method is used, a service life of the device can be greatly expanded. Materials for forming the pulverization toner are not particularly restricted, and can be selected from those generally used for an electrophotographic toner.

The developing unit may be employ a dry developing system, or wet developing system, and may be a developing unit for a singly color, or a developing unit for a multi-color. Examples of the developing device include a device having a stirrer configured to charge the toner or the developer by frictions from stirring, and a rotatable magnetic roller.

In the developing unit, for example, the toner and the carrier are mixed and stirred, and the toner is charged by the friction from the stirring. The charged toner is held on the surface of the rotatable magnetic roller in the form of a brush to form a magnetic brush. The magnetic roller is provided adjacent to the image bearing member (photoconductor), part of the toner forming the magnetic brush on the surface of the magnetic roller is moved to the surface of the image bearing member (photoconductor) by electrical attraction force. As a result, the latent electrostatic image is developer with the toner to form a visible image of the toner on the surface of the image bearing member (photoconductor).

The developer housed in the developing unit is the developer containing the toner, but it may be a one-component developer or two-component developer.

Transferring Step and Transferring Unit

The transferring step is transferring the visible image to a recording member. The preferable embodiment thereof uses an intermediate transferring member, and is primary transferring the visible image on the intermediate transferring member, followed by secondary transferring the visible image to a recording medium, where two or more colors of the toner is used, more preferably, full color of the toner is used. The more preferable embodiment includes a primary transferring step, which is transferring visible images to an intermediate transferring member to form a composite transfer image, and a secondary transferring step, which is transferring the composite transfer image to a recording medium.

The transferring can be performed by charging the image bearing member (photoconductor) on which the visible image is formed, for example, by means of a transfer charger, and it can be performed by the transferring unit. A preferable embodiment of the transferring unit contains a primary transferring unit configured to transfer visible images to an intermediate transferring member to form a composite transfer image, and a secondary transferring unit configured to transfer the composite transfer image to a recording medium.

The intermediate transfer member is appropriately selected from transferring members known in the art depending on the intended purpose without any restriction, and for example, the intermediate transfer member is preferably a transfer belt or the like.

The image bearing member may be an intermediate transferring member, to which toner images formed on a photoconductor are primary transferred to superimpose toner images of different colors, and from which the superimposed image is transferred to a recording medium. Specifically, the image bearing member may be an intermediate transferring member used for image formation of an intermediate transferring system.

Intermediate Transferring Member

The intermediate transferring member preferably has a conductivity of $1.0\times10^{5}$ Ω·cm to $1.0\times10^{11}$ Ω·cm based on the volume resistivity. When the volume resistivity is lower than $1.0\times10^{5}$ Ω·cm, so-called transfer scattering occur, which is distortion of a toner image due to discharge generated when the toner image is transferred from the photoconductor to the intermediate transferring member. When the volume resistivity thereof is higher than $1.0\times10^{11}$ Ω·cm, counter charge of the toner image is remained on the intermediate transferring member after the toner image is transferred from the intermediate transferring member to a recording medium, such as paper, which may cause image lag (a residual image) on a subsequently processed image.

As the intermediate transferring medium, for example, a belt-shaped or cylindrical plastic product which is produced by the following manner can be used. Specifically, conductive particles of a metal oxide (e.g. tin oxide, and indium oxide), carbon black or the like and/or conductive polymers are used alone or in combination and kneaded with a thermoplastic resin, and the kneaded product is subjected to extrusion-molding. Besides the above method, an intermediate transferring member in the form of an endless belt can also be produced in the following manner. Specifically, the above-mentioned conductive particles and/or conductive polymers are added, when necessary, to a resin-based liquid containing a heat-crosslinkable monomer or oligomer, the materials are centrifugally molded under application of heat.

In the case where a surface layer is provided on the intermediate transferring member, the aforementioned materials used for the outermost layer of the photoconductor excluding the charge transporting material are used optionally in combination with a conductive material for controlling the resistance of the resulting intermediate transferring member.

The transferring unit (e.g. in combination of the primary transferring unit, and the secondary transferring unit) preferably contains at least a transferrer configured to charge the visible image to thereby release the visible image formed on the image bearing member (photoconductor) from the image bearing member to the side of a recording medium. The number of the transferring unit(s) mounted may be 1, or 2 or more. Examples of the charger include a corona transferrer utilizing corona discharge, a transfer belt, a transfer roller, a pressure transfer roller, and an adhesion transferrer.

The recording medium for use is appropriately selected from recording media (recording paper) known in the art without any restriction.

Protective Layer Forming Step and Protective Layer Forming Unit

The protective layer forming step is applying a protecting agent to a surface of the image bearing member after the transferring to form a protective layer.

As the protective layer forming unit, the protective layer forming device of the present invention, which is described above, can be used.

Fixing Step and Fixing Unit

The fixing step is fixing the visible image transferred onto the recording medium thereon by means of the fixing unit, and fixing may be performed every time the visible image formed of the toner of each color is transferred to the recording medium, or performed once after all the visible images each formed of the toner of each color are laminated.

The fixing unit is appropriately selected depending on the intended purpose without any restriction, but it is preferably any of a heating pressurizing unit known in the art. Examples of the heating pressurizing unit include a combination of a heating roller and a pressure roller, and a combination of a heating roller, a pressure roller, and an endless belt.

The temperature for heating by the heating pressurizing unit is generally preferably 80° C. to 200° C.

Note that, in combination with or instead of the fixing step and the fixing unit, an optical fixing unit known in the art may be used.

Diselectrification Step and Diselectrification Unit

The diselectrification step is applying diselectrification bias to the image bearing member to diselectrify the image bearing member, and the diselectrification step can be carried out with the diselectrification unit.

The diselectrification unit is not particularly restricted, as long as it is capable of applying diselectrification bias to the latent electrostatic image bearing member, and preferable examples thereof include a diselectrification lamp.

Cleaning Step and Cleaning Unit

The cleaning step is removing the residual toner on the latent electrostatic image bearing member, and the cleaning step can be carried out with the cleaning unit.

The cleaning unit is preferably provided at the downstream of the transferring unit and the upstream of the protective layer forming unit.

The cleaning unit is not particularly restricted, as long as it is capable of removing the residual toner on the image bearing member, and examples thereof include a magnetic brush cleaner, an electrostatic brush cleaner, a magnetic roller cleaner, a blade cleaner, a brush cleaner, and a web cleaner.

Recycling Step and Recycling Unit

The recycling step is recycling the toner removed in the cleaning step to the developing unit, and the recycling can be performed by the recycling unit.

The recycling unit is not particularly restricted, and as the recycling unit, conventional conveying units, and the like can be used.

Controlling Step and Controlling Unit

The controlling step is controlling operation of each step, and the controlling can be performed by the controlling unit.

The controlling unit is appropriately selected depending on the intended purpose without any restriction provided that it is capable of controlling operations of each unit, and examples thereof include a sequencer, and a computer.

Figure 16:
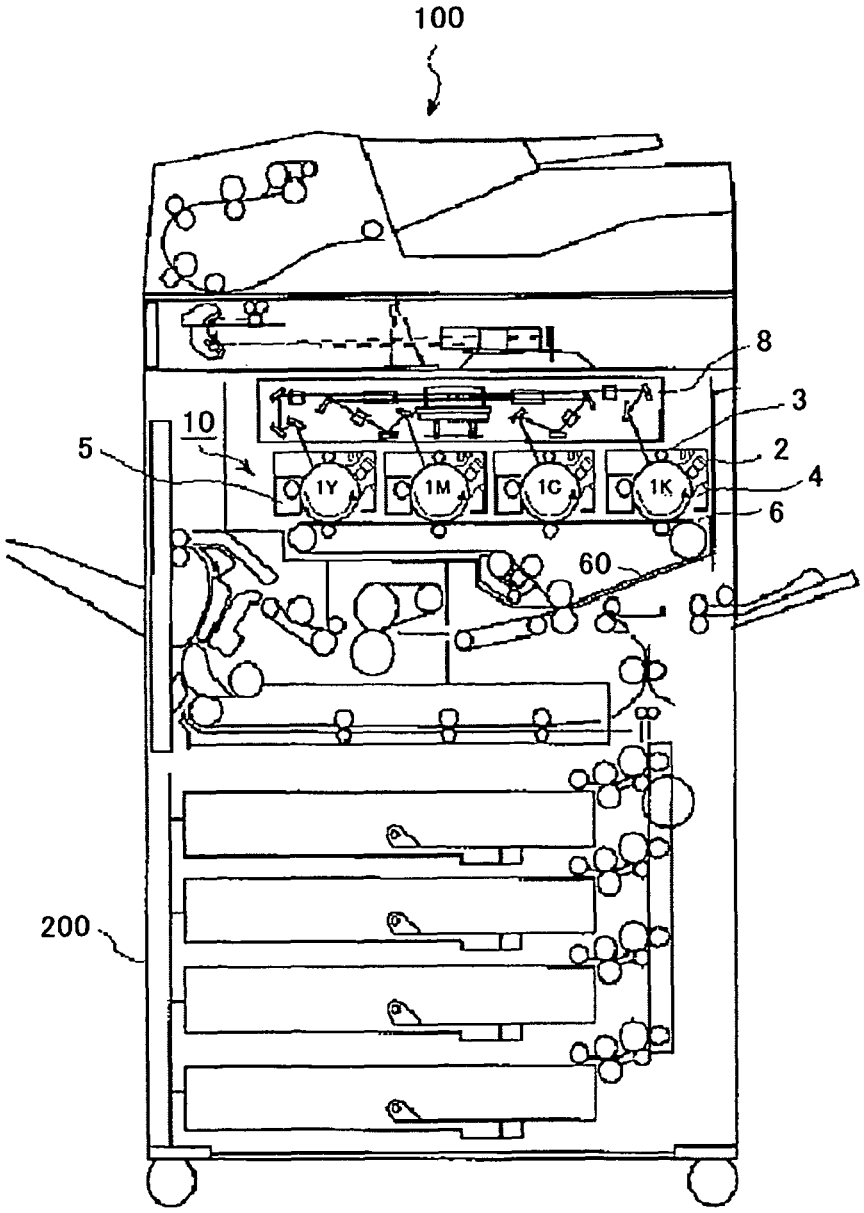
FIG. 16 is a schematic cross-sectional view illustrating one example of the image forming apparatus of the present invention.

FIG. 16 is a schematic cross-sectional view illustrating one example of the image forming apparatus 100 of the present invention.

At the periphery of each of the drum-shaped image bearing members 1Y, 1M, 1C, and 1K, a protective layer forming device 2, a charging device 3, a latent image forming device 8, a developing device 5, a transferring device 6, and a cleaning device 4 are provided, and the image formation is carried out in the following operations.

A series of processes for the image formation will be explained through a negative-positive process, hereinafter.

The image bearing member, which is represented by a photoconductor having an organic photoconductive layer (OPC), is diselectrificated by a diselectrification lamp (not illustrated), and then is uniformly negatively charged by the charging device 3 having a charging member.

In the course of the charging of the image bearing member by the charging device, an appropriate level of the voltage suitable for charging the image bearing members 1Y, 1M, 1C, and 1K to have desirable electric potential, or a charging voltage in which the alternating voltage is superimposed to the voltage as mentioned is applied to the charging member from the voltage applying unit (not illustrated).

The charged image bearing members 1Y, 1M, 1C, and 1K are each irradiated with laser light by means of a latent image forming device 8 of laser optics or the like, to thereby form a latent image (the absolute value of the potential of the exposed area is lower the absolute value of the potential of the non-exposed area).

Laser light is emitted from a semiconductor laser, which scans the surface of the image bearing member 1Y, 1M, 1C, or 1K in the rotational direction of the image bearing member by a polygon mirror in the shape of the polygonal prism, which rotates at high speed.

The latent image formed in the manner mentioned above is developed with toner particles, or a developer formed of a mixture of toner particles and carrier particles, supplied on a developing sleeve, which is a developer bearing member of the developing device 5, to thereby form a toner visible image.

At the time of the developing of the latent image, an appropriate level of the voltage, or a developing bias in which the alternating voltage is superimposed to the voltage as mentioned is applied from the voltage applying unit (not illustrated) to the developing sleeve which is located between the exposed area and the unexposed area in each of the image bearing members 1Y, 1M, 1C, and 1K.

The toner images respectively formed on the image bearing members 1Y, 1M, 1C, and 1K, where the toner images formed are each corresponded to each of the colors of the toner used, are transferred onto the intermediate transferring member 60 by the transferring device 6, and then transferred from the intermediate transferring member 60 to a recording medium, such as paper, fed by the paper feeding unit 200.

During this operation, it is preferred that a voltage having the reverse polarity to that of the charge of the toner be applied to the transferring device 6 as transfer bias. After applying the voltage mentioned above, the intermediate transferring member 60 is separated from the image bearing member, and as a result a transferred image is obtained on the intermediate transferring member 60.

The toner particles remained on the image bearing member are collected into a toner collecting chamber in the cleaning device 4, by means of the cleaning member.

The image forming apparatus may have a plurality of the developing devices mentioned above, and is a device in which a plurality of toner images each being in a different color are successively formed by the plurality of the developing devices, the toner images as formed are successively transferred, and the transferred images are forwarded to a fixing unit to thereby fix the toner by heat or the like. Alternatively, the image forming apparatus is a device in which a plurality of toner images formed in the same manner as above are successively transferred to the intermediate transferring member temporarily, and the transferred toner images are transferred to a recording medium such as paper at once, followed by performing the fixing in the same manner as above.

Moreover, the charging device 3 is preferably a charging device arranged to be in contact with or adjacent to the surface of the image bearing member, and the discharge wire is used in the embodiment mentioned above. Use of the discharge wire can significantly reduce the amount of ozone generated during charging compared to the amount generated by a corona discharger such as corotron and scorotron.

Process Cartridge

The process cartridge contains at least an image bearing member, and the protective layer forming unit (device) of the present invention, and may further contain other units such as a charging unit, an exposing unit, a developing unit, a transferring unit, a cleaning unit, and a diselectrification unit, if necessary.

The process cartridge is detachably mounted in various electrophotographic devices, and is preferably detachably mounted in the image forming apparatus of the present invention described earlier.

Figure 17:
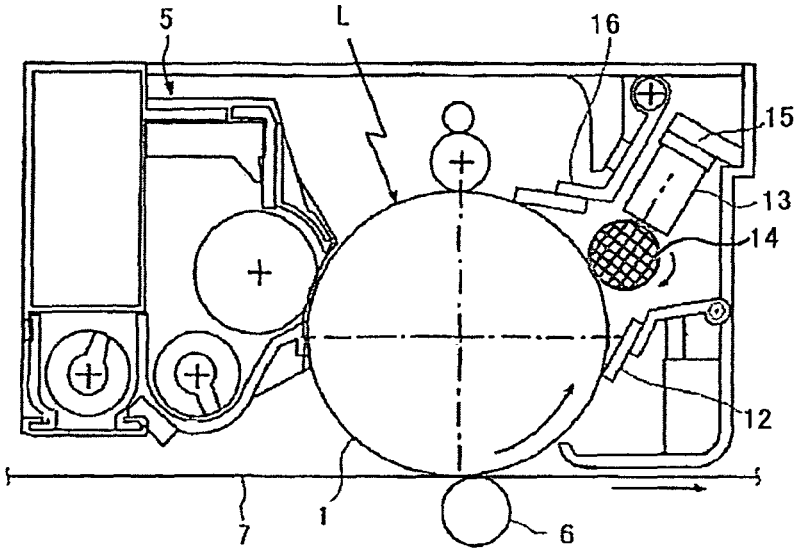
FIG. 17 is a schematic cross-sectional view illustrating one example of a process cartridge of the present invention.

FIG. 17 is a schematic cross-sectional view illustrating one example of the process cartridge.

The process cartridge contains a photoconductor drum 1 serving as an image bearing member, and a protective layer forming device 2 arranged to face the photoconductor drum, where the protective layer forming device 2 contains a protecting agent block 13, a protecting agent supplying member 14, a pressing force applying member 15, a protective layer forming member 16, and the like.

After the transferring step, the image bearing member has the partially deteriorated protecting agent for the image bearing member, or toner component, remained on the surface thereof, and these residuals on the surface of the image bearing member is cleaned with a cleaning member 12.

In FIG. 17, the cleaning member is brought into contact with the image bearing member at the angle, which is so-called, a counter type (leading type).

To the surface of the image bearing member from which the residual toner and/or protecting agent for the image bearing member is removed by the cleaning member 12, a protecting agent is supplied from the protecting agent supplying member 14, and a protective layer in the form of a film is formed by the protective layer forming member 16.

The image bearing member onto which the protective layer has been used in the manner mentioned above is then charged, and exposed to exposure light L such as laser to thereby form a latent electrostatic image, and the formed latent electrostatic image is developed by a developing device 5 to make the image visible, followed by transferring the visible image to a recording medium 7 by a transferring device 6 mounted outside the process cartridge.

EXAMPLES

Examples of the present invention will be explained hereinafter, but these examples shall not be construed as to limit the scope of the present invention in any way.

Production Example 1

Production of Protecting Agent Block 1

A mixture of 90 parts by mass of zinc stearate (GF-200, manufactured by NOF CORPORATION) and 10 parts by mass of boron nitride (NX5, manufactured by Momentive Performance Materials Inc.) was placed in a predetermined mold, and leveled, followed by being compressed at the pressure of 130 kN for 10 seconds, to thereby yield Protecting Agent Block 1 in the shape of a quadrangular prism having the lengths of 10 mm in the height direction, 8 mm in the transverse direction, and 320 mm in the length direction.

Production Example 2

Production of Protecting Agent Block 2

A mixture of 90 parts by mass of zinc stearate (GF-200, manufactured by NOF CORPORATION) and 10 parts by mass of talc (PFI Talc, manufactured by Miyoshi Kasei, Inc.) was placed in a predetermined mold, and leveled, followed by being compressed at the pressure of 130 kN for 10 seconds, to thereby yield Protecting Agent Block 2 in the shape of a quadrangular prism having the lengths of 10 mm in the height direction, 8 mm in the transverse direction, and 320 mm in the length direction.

Production Example 3

Production of Protecting Agent Block 3

A mixture of 90 parts by mass of zinc stearate (GF-200, manufactured by NOF CORPORATION) and 10 parts by mass of mica (SA Mica, manufactured by Miyoshi Kasei, Inc.) was placed in a predetermined mold, and leveled, followed by being compressed at the pressure of 130 kN for 10 seconds, to thereby yield Protecting Agent Block 3 in the shape of a quadrangular prism having the lengths of 10 mm in the height direction, 8 mm in the transverse direction, and 320 mm in the length direction.

Production Example 4

Production of Protecting Agent Block 4

In a predetermined mold, zinc stearate (GF-200, manufactured by NOF CORPORATION) was placed, and leveled, followed by being compressed at the pressure of 130 kN for 10 seconds, to thereby yield Protecting Agent Block 4 in the shape of a quadrangular prism having the lengths of 10 mm in the height direction, 8 mm in the transverse direction, and 320 mm in the length direction.

Production Example 5

Production of Protecting Agent Block 5

A mixture of 90 parts by mass of zinc stearate (GF-200, manufactured by NOF CORPORATION) and 10 parts by mass of boron nitride (NX5, manufactured by Momentive Performance Materials Inc.) was fused, followed by placing the mixture in a predetermined mold, to thereby yield Protecting Agent Block 5.

Protecting Agent Block 5 obtained was in the shape of a quadrangular prism having the lengths of 10 mm in the height direction, 8 mm in the transverse direction, and 320 mm in the length direction.

Production Example 6

Production of Protecting Agent Block 6

After fusing zinc stearate (GF-200, manufactured by NOF CORPORATION), the zinc stearate was placed in a predetermined mold to thereby yield Protecting Agent Block 6.

Protecting Agent Block 6 obtained was in the shape of a quadrangular prism having the lengths of 10 mm in the height direction, 8 mm in the transverse direction, and 320 mm in the length direction.

TABLE 1

| | | Molding method | Fatty acid metal salt | Inorganic lubricant |
|---|---|---|---|---|
| Production Example 1 | Protecting Agent Block 1 | Compression molding | Zinc stearate | Boron nitride |
| Production Example 2 | Protecting Agent Block 2 | Compression molding | Zinc stearate | Talc |
| Production Example 3 | Protecting Agent Block 3 | Compression molding | Zinc stearate | Mica |
| Production Example 4 | Protecting Agent Block 4 | Compression molding | Zinc stearate | — |
| Production Example 5 | Protecting Agent Block 5 | Fusion molding | Zinc stearate | Boron nitride |
| Production Example 6 | Protecting Agent Block 6 | Fusion molding | Zinc stearate | — |

Example 1

Production of Protecting Agent Supplying Member 1

Polyurethane foam (EVERLIGHT SF QZK-70, manufactured by Bridgestone Diversified Chemical Products Co., Ltd.) was cut into the predetermined size, followed by making a hole for inserting a core (made of a stainless steel having the average diameter of 6 mm, and length of 365 mm) in the cut polyurethane foam. The core was inserted into the hole and fixed to the polyurethane form. Thereafter, the polyurethane foam was cut out in the shape of a roller in which the core was present as an axis, and polished, to thereby form a foam layer formed of the polyurethane foam at the periphery of the core. Thereafter, concavities were formed in the foam layer in the direction parallel to the axial direction of the foam layer by means of a cutting device, to thereby produce Protecting Agent Supplying Member 1.

As illustrated in FIG. 1, the concavities were arranged in the foam layer of Protecting Agent Supplying Member 1 to align in the direction substantially parallel to the axial direction of Protecting Agent Supplying Member 1, and were arranged substantially uniformly in the circumferential direction of Protecting Agent Supplying Member 1 with a constant space between the concavities. Each concavity was in the shape of substantially a rectangular prism.

The average distance (a1) between the internal perimeter surface of the foam layer and the bottom face of the concavity was 0.5 mm, the average distance (a2) between the bottom face and the top face of the concavity was 2.5 mm, the average distance (b) between a couple of the concavities next to each other was 1.5 mm, the average width (c) of the foam layer present between a couple of the concavities next to each other was 0.375 mm, and the ratio (c/b) was 0.25.

Moreover, Protecting Agent Supplying Member 1 obtained was in the shape of a roller. The foam layer of Protecting Agent Supplying Member 1 had an interconnected cell structure, and the average thickness of 3.0 mm. The number of cells was 70 per inch, and the hardness was 150 N.

Measurements

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the number of cells, and the hardness were measured in the following manners.

Average Distance (a2) Between Bottom Face and Top Face of Concavity

The bottom face and top face of the concavity was measured at 5 spots by a carpenter's square, and from the average value of the measurement values as obtained, the average distance (a2) between the bottom face and the top face of the concavity was obtained.

Average Distance (a1) Between Internal Perimeter Surface of Foam Layer and Bottom Face of Concavity The periphery of the protecting agent supplying member was measured by a laser roller measurement system (RSV-1560PIIC, manufactured by Tokyo Opto-Electronics Co., Ltd.), and from which the diameter (A1) was calculated. Moreover, the diameter (A2) of the core was measured by a caliper. The difference (A1−A2) of the diameter (A1) of the protecting agent supplying member and the diameter (A2) of the core was divided by 2, to thereby obtain the thickness (A) of the foam layer. The thickness (A) of the foam layer was measured at 5 spots, from the average value of the measured values, the average thickness was obtained. Then, from the difference of the average thickness of the foam layer and the above-obtained average distance (a2) between the bottom face and the top face of the concavity, the average distance (a1) between the internal perimeter surface of the foam layer and the bottom face of the concavity was determined.

Average Distance (b) Between Concavities Next to Each Other

The distance between a couple of concavities next to each other was measured at 5 spots by a carpenter's square, and from the average value of the measured values, the average distance (b) between a couple of the concavities next to each other was obtained.

Average Width (c) of Foam Layer Present Between Concavities Next to Each Other

The width of the foam layer present between a couple of the concavities next to each other was measured at 5 spots by a carpenter's square, and from the average value of the measured values, the average width (c) of the foam layer present between a couple of the concavities next to each other was obtained.

Number of Cells

Three spots were randomly selected as the measuring spots on the surface of the foam layer, and the three spots were respectively in the parts near the edges, and in the central part of the foam layer with respect to the axial direction of the protecting agent supplying member.

Next, in each measuring spot, 2 spots were further selected in the circumferential direction, so that 9 spots were selected as the measuring spots, in total. Then, a photographic image of each measuring spot was observed by a microscope, and a line of the length (approximately 25 mm) corresponding to 1 inch in the full size was drawn in the center part of the photographic image, and the number of cells present along the line was counted, and the average value of the values obtained from the 9 measuring spots were obtained. Note that, a cell which was in contact with the 1-inch line, even at the slightest degree, was counted as one.

Hardness

The hardness was measured at randomly selected 3 spots on the surface of the foam layer by the method specified in JIS K 6400, and the average value of these measured values was obtained.

Evaluation

In an image forming section of IMAGIO MP C5000, manufactured by Ricoh Company Limited, a zinc stearate block originally mounted therein was replaced with Protecting Agent Block 1. Moreover, a brush roller originally mounted therein was replaced with Protecting Agent Supplying Member 1.

The configuration of the protective layer forming device of the modified device as mentioned above was illustrated in FIG. 15.

In this device, the penetrating depth of Protecting Agent Supplying Member 1 at the time when Protecting Agent Supplying Member 1 was brought into contact with the image bearing member was set to 1.0 mm. The penetrating depth means that the maximum deformation amount of the foam layer in the depth direction, when the protecting agent supplying member is brought into contact with the image bearing member.

Note that, IMAGIO MP C5000 of Ricoh Company Limited used in this example employs the technology disclosed in JP-A No. 2007-293740 in the pressing force applying member which presses the protecting agent block to thereby bring the protecting agent block into contact with the protecting agent supplying member, which can apply uniform pressure to the protecting agent block in the length direction with the constant pressure. Note that, the pressure as mentioned, i.e. the pressing force to the protecting agent block, was 5 N.

The document in the size of A4, and at the imaging area rate of 100% was continuously printed on 1,000 pieces.

Filming of Image Bearing Member

Occurrence of filming to the image bearing member after the continuous printing of 1,000 pieces was visually observed, and evaluated based on the following criteria. The results are shown in Table 2-2.

A: Filming did not occur at all.

B: Filming hardly occurred and the condition was excellent.

C: Filming occurred, but it was under the tolerance level.

D: Filming occurred significantly, and it was beyond the tolerance level.

Contamination of Charging Member

The contamination of the charging member (the charging roller) was observed after the continuous printing of 1,000 pieces, and the evaluated based on the following criteria. The results are shown in Table 2-2.

A: Contamination did not occur at all.

B: Contamination hardly occurred, and the condition was excellent.

C: Contamination occurred, but it was under the tolerance level.

D: Contamination occurred significantly, and it was beyond the tolerance level.

Examples 2 to 18

Production of Protecting Agent Supplying Members 2 to 18

Protecting Agent Supplying Members 2 to 18 were each produced in the same manner as in Example 1, provided that the average distance (a1) between the internal perimeter surface of the foam layer and the bottom face of the concavity, the average distance (a2) between the bottom face of the concavity and the top face of the concavity, the average distance (b) between a couple of the concavities next to each other, and the average width (c) of the foam layer present between a couple of the concavities next to each other were changed to those presented in Table 2-1.

Protecting Agent Supplying Members 2 to 18 obtained were all in the shape of a roller. The foam layer in each protecting agent supplying member had an interconnected cell structure, and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b)), the number of cells, and the hardness of each of Protecting Agent Supplying Members 2 to 18 are shown in Table 2-1.

Evaluation

The evaluation was carried out in the same manner as in Example 1, provided that the protecting agent supplying member was replaced with the protecting agent supplying member presented in Table 2-1. The results are shown in Tables 2-1 and 2-2.

Examples 19 to 21

Evaluation

Evaluation was carried out in the same manner as in Example 13, provided that the protecting agent block was changed to the protecting agent block presented in Table 2-2. The results are shown in Tables 2-1 and 2-2.

Example 22

Production of Protecting Agent Supplying Member 19

Protecting Agent Supplying Member 19 was produced in the same manner as in Example 13, provided that the polyurethane foam was changed to polyurethane foam (EVERLIGHT SF HR-20, manufactured by Bridgestone Diversified Chemical Products Co., Ltd.).

Protecting Agent Supplying Member 19 obtained was in the shape of a roller. The foam layer of Protecting Agent Supplying Member 19 had an interconnected cell structure, and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 19 are shown in Table 2-1.

Evaluation

Evaluation was carried out in the same manner as in Example 13, provided that the protecting agent supplying member was changed to Protecting Agent Supplying Member 19. The results are shown in Tables 2-1 and 2-2.

Example 23

Production of Protecting Agent Supplying Member 20

Protecting Agent Supplying Member 20 was produced in the same manner as in Example 13, provided that the polyurethane foam was changed to polyurethane foam (EVERLIGHT SF QZK-70 (product of 3 times the density), manufactured by Bridgestone Diversified Chemical Products Co., Ltd.).

Protecting Agent Supplying Member 20 obtained was in the shape of a roller. The foam layer of Protecting Agent Supplying Member 20 had an interconnected cell structure, and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 20 are shown in Table 2-1.

Evaluation

Evaluation was carried out in the same manner as in Example 13, provided that the protecting agent supplying member was changed to Protecting Agent Supplying Member 20. The results are shown in Tables 2-1 and 2-2.

Example 24

Production of Protecting Agent Supplying Member 21

Protecting Agent Supplying Member 21 was produced in the same manner as in Example 13, provided that the polyurethane foam was changed to polyurethane foam (EVERLIGHT SF EPT, manufactured by Bridgestone Diversified Chemical Products Co., Ltd.).

Protecting Agent Supplying Member 21 obtained was in the shape of a roller. The foam layer of Protecting Agent Supplying Member 21 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 21 are shown in Table 2-1.

Evaluation

Evaluation was carried out in the same manner as in Example 13, provided that the protecting agent supplying member was changed to Protecting Agent Supplying Member 21. The results are shown in Tables 2-1 and 2-2.

Example 25

Evaluation

Evaluation was carried out in the same manner as in Example 13, provided that the protecting agent block was changed to Protecting Agent Block 5. The results are shown in Tables 2-1 and 2-2.

Example 26

Production of Protecting Agent Supplying Member 22

Protecting Agent Supplying Member 22 was produced in the same manner as in Example 13, provided that the thickness of the foam layer was changed to 2 mm, and the average distance (a1) between the internal perimeter surface of the foam layer and the bottom face of the concavity was changed to 1.7 mm.

Protecting Agent Supplying Member 22 obtained was in the shape of a roller. The foam layer of Protecting Agent Supplying Member 22 had an interconnected cell structure and a thickness of 2 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 22 are shown in Table 2-1.

Evaluation

Evaluation was carried out in the same manner as in Example 13, provided that the protecting agent supplying member was changed to Protecting Agent Supplying Member 22. The results are shown in Tables 2-1 and 2-2.

Example 27

Production of Protecting Agent Supplying Member 23

Protecting Agent Supplying Member 23 was produced in the same manner as in Example 13, provided that the thickness of the foam layer was changed to 4 mm, and the average distance (a1) between the internal perimeter surface of the foam layer and the bottom face of the concavity was changed to 3.7 mm.

Protecting Agent Supplying Member 23 obtained was in the shape of a roller. The foam layer of Protecting Agent Supplying Member 23 had an interconnected cell structure and a thickness of 4 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 23 are shown in Table 2-1.

Evaluation

Evaluation was carried out in the same manner as in Example 13, provided that the protecting agent supplying member was changed to Protecting Agent Supplying Member 23. The results are shown in Tables 2-1 and 2-2.

Example 28

Production of Protecting Agent Supplying Member 24

Protecting Agent Supplying Member 24 was produced in the same manner as in Example 12, provided that the concavities were provided in the surface of the foam layer to be aligned in the direction of 45° in the angle with respect to the direction parallel to the axial direction of the protecting agent supplying member, and were substantially uniformly provided in the direction perpendicular to the aforementioned direction with a constant space therebetween. The concavities formed in Protecting Agent Supplying Member 24 obtained were each in the shape of a spiral quadrangular prism, and were arranged in the spiral manner.

Protecting Agent Supplying Member 24 obtained was in the shape of a roller. The foam layer of Protecting Agent Supplying Member 24 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of Protecting Agent Supplying Member 24 are shown in Table 2-1.

Evaluation

Evaluation was carried out in the same manner as in Example 12, provided that the protecting agent supplying member was changed to Protecting Agent Supplying Member 24. The results are shown in Tables 2-1 and 2-2.

Examples 29 to 34

Production of Protecting Agent Supplying Members 25 to 30

Protecting Agent Supplying Members 25 to 30 were each produced in the same manner as in Example 1, provided that the average distance (a1) between the internal perimeter surface of the foam layer and the bottom face of the concavity, the average distance (a2) between the bottom face and the top face of the concavity, the average distance (b) between a couple of the concavities next to each other, and the average width (c) of the foam layer present between a couple of the concavities next to each other of each of Protecting Agent Supplying Members 25 to 30 were respectively changed to those presented in Table 2-1.

Protecting Agent Supplying Members 25 to 30 obtained were each in the shape of a roller. The foam layer of each of Protecting Agent Supplying Members 25 to 30 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b) between a couple of the concavities next to each other, the average width (c) of the foam layer present between a couple of the concavities next to each other, the ratio (c/b), the number of cells, and the hardness of each of Protecting Agent Supplying Members 25 to 30 are shown in Table 2-1.

Evaluation

Evaluation was carried out in the same manner as in Example 1, provided that the protecting agent supplying member was changed to the protecting agent supplying member presented in Table 2-1. The results are shown in Tables 2-1 and 2-2.

Example 35

Evaluation

Evaluation was carried out in the same manner as in Example 13, provided that the protecting agent block was changed to Protecting Agent Block 6. The results are shown in Tables 2-1 and 2-2.

Comparative Example 1

Production of Protecting Agent Supplying Member 31

Protecting Agent Supplying Member 31 was produced in the same manner as in Example 1, provided that the concavities regularly formed in the surface of the foam layer were not formed.

Protecting Agent Supplying Member 31 obtained was in the shape of a roller. The foam layer of Protecting Agent Supplying Member 31 had an interconnected cell structure and a thickness of 3 mm. The number of cells, and the hardness of Protecting Agent Supplying Member 31 are shown in Table 2-1.

Evaluation

Evaluation was carried out in the same manner as in Example 1, provided that the protecting agent supplying member was changed to Protecting Agent Supplying Member 31, and the protecting agent block was changed to Protecting Agent Block 6. The results are shown in Tables 2-1 and 2-2.

Example 36

Production of Protecting Agent Supplying Member 32

Polyurethane foam (EVERLIGHT SF QZK-70, manufactured by Bridgestone Diversified Chemical Products Co., Ltd.) was cut into the predetermined size, followed by making a hole for inserting a core (made of a stainless steel having the average diameter of 6 mm, and length of 365 mm) in the cut polyurethane foam. The core was inserted into the hole and fixed to the polyurethane form. Thereafter, the polyurethane foam was cut out in the shape of a roller in which the core was present as an axis, and polished, to thereby form a foam layer formed of the polyurethane foam at the periphery of the core. Thereafter, concavities were formed in the foam layer in the direction parallel to the axial direction of the foam layer by means of a cutting device, to thereby produce Protecting Agent Supplying Member 32.

As illustrated in FIG. 6, the concavities each substantially in the shape of a rectangular prism were uniformly arranged in the foam layer of Protecting Agent Supplying Member 32 in the lattice pattern. This lattice pattern was a lattice pattern where each concavity and the foam were alternately aligned both in the axial direction and circumferential direction of Protecting Agent Supplying Member 32.

The average distance (a1) between the internal perimeter surface of the foam layer and the bottom face of the concavity was 0.5 mm, and the average distance (a2) between the bottom face and the top face of the concavity was 2.5 mm. Moreover, the average distance (b1) between a couple of the concavities next to each other in the axial direction was 1.5 mm, the average width (c1) of the foam layer present between a couple of the concavities next to each other in the axial direction was 0.375 mm, and the ratio (c1/b1) was 0.25. The average distance (b2) between a couple of the concavities next to each other in the circumferential direction was 1.5 mm, the average width (c2) of the foam layer present between a couple of the concavities next to each other in the circumferential direction was 0.375 mm, and the ratio (c2/b2) was 0.25.

Furthermore, Protecting Agent Supplying Member 32 obtained was in the shape of a roller. The foam layer of Protecting Agent Supplying Member 32 had an interconnected cell structure, and the average thickness of 3.0 mm. The number of cells was 70 per inch, and the hardness was 150 N.

Measurements

The average distance (b1) between a couple of the concavities next to each other, and the average distance (b2) between a couple of the concavities next to each other were measured in the same manner as in the measurement of the average distance (b) between a couple of the concavities next to each other.

The average width (c1) of the foam layer present between a couple of the concavities next to each other, and the average width (c2) of the foam layer present between a couple of the concavities next to each other were measured in the same manner as in the measurement of the average width (c) of the foam layer present between a couple of the concavities next to each other.

Evaluation

Evaluation was carried out in the same manner as in Example 1, provided that the protecting agent supplying member was changed to Protecting Agent Supplying Member 32. The results are shown in Tables 3-1 and 3-2.

Examples 37 to 53

Production of Protecting Agent Supplying Members 33 to 49

Protecting Agent Supplying Members 33 to 49 were each produced in the same manner as in Example 36, provided that the average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the average distance (b2) between a couple of the concavities next to each other in the circumferential direction, and the average width (c2) of the foam layer present between a couple of the concavities next to each other in the circumferential direction were respectively changed to those presented in Table 3-1.

Protecting Agent Supplying Members 33 to 49 obtained were each in the shape of a roller. The foam layer of each of Protecting Agent Supplying Members 33 to 49 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of each of Protecting Agent Supplying Members 33 to 49 are shown in Table 3-1.

Evaluation

Evaluation was carried out in the same manner as in Example 36, provided that the protecting agent supplying member was changed to the protecting agent supplying member presented in Table 3-1. The results are shown in Tables 3-1 and 3-2.

Examples 54 to 56

Production of Protecting Agent Supplying Member 50

Protecting Agent Supplying Member 50 was produced in the same manner as in Example 36, provided that the average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the average distance (b2) between a couple of the concavities next to each other in the circumferential direction, and the average width (c2) of the foam layer present between a couple of the concavities next to each other in the circumferential direction were changed respectively to those presented in Table 3-1.

Protecting Agent Supplying Member 50 obtained was in the shape of a roller. The foam layer of Protecting Agent Supplying Member 50 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 50 are shown in Table 3-1.

Evaluation

Evaluation was carried out in the same manner as in Example 36, provided that the protecting agent supplying member and the protecting agent block were respectively changed to Protecting Agent Supplying Member 50 and the protecting agent block presented in Tables 3-1 and 3-2. The results are shown in Tables 3-1 and 3-2.

Example 57

Production of Protecting Agent Supplying Member 51

Protecting Agent Supplying Member 51 was produced in the same manner as in Example 54, provided that the polyurethane foam was changed to polyurethane foam (EVERLIGHT SF HR-20, manufactured by Bridgestone Diversified Chemical Products Co., Ltd.).

Protecting Agent Supplying Member 51 obtained was in the shape of a roller. The foam layer of Protecting Agent Supplying Member 51 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 51 are shown in Table 3-1.

Evaluation

Evaluation was carried out in the same manner as in Example 36, provided that the protecting agent supplying member was changed to Protecting Agent Supplying Member 51. The results are shown in Tables 3-1 and 3-2.

Example 58

Production of Protecting Agent Supplying Member 52

Protecting Agent Supplying Member 52 was produced in the same manner as in Example 54, provided that the polyurethane foam was changed to polyurethane foam (EVERLIGHT SF QZK-70 (a product of 3 times the density), manufactured by Bridgestone Diversified Chemical Products Co., Ltd.).

Protecting Agent Supplying Member 52 obtained was in the shape of a roller. The foam layer of Protecting Agent Supplying Member 52 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 52 are shown in Table 3-1.

Evaluation

Evaluation was carried out in the same manner as in Example 36, provided that the protecting agent supplying member was changed to Protecting Agent Supplying Member 52. The results are shown in Tables 3-1 and 3-2.

Example 59

Production of Protecting Agent Supplying Member 53

Protecting Agent Supplying Member 53 was produced in the same manner as in Example 54, provided that the polyurethane foam was changed to polyurethane foam (EVERLIGHT SF EPT, manufactured by Bridgestone Diversified Chemical Products Co., Ltd.).

Protecting Agent Supplying Member 53 obtained was in the shape of a roller. The foam layer of Protecting Agent Supplying Member 53 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 53 are shown in Table 3-1.

Evaluation

Evaluation was carried out in the same manner as in Example 36, provided that the protecting agent supplying member was changed to Protecting Agent Supplying Member 53. The results are shown in Tables 3-1 and 3-2.

Example 60

Evaluation

Evaluation was carried out in the same manner as in Example 54, provided that the protecting agent block was changed to Protecting Agent Block 5. The results are shown in Tables 3-1 and 3-2.

Example 61

Production of Protecting Agent Supplying Member 54

Protecting Agent Supplying Member 54 was produced in the same manner as in Example 54, provided that the thickness of the foam layer was changed to 2 mm, and the average distance (a1) between the internal perimeter surface of the foam layer and the bottom face of the concavity was changed to 1.7 mm.

Protecting Agent Supplying Member 54 obtained was in the shape of a roller. The foam layer of Protecting Agent Supplying Member 54 had an interconnected cell structure and a thickness of 2 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 54 are shown in Table 3-1.

Evaluation

Evaluation was carried out in the same manner as in Example 36, provided that the protecting agent supplying member was changed to Protecting Agent Supplying Member 54. The results are shown in Tables 3-1 and 3-2.

Example 62

Production of Protecting Agent Supplying Member 55

Protecting Agent Supplying Member 55 was produced in the same manner as in Example 54, provided that the thickness of the foam layer was changed to 4 mm, and the average distance (a1) between the internal perimeter surface of the foam layer and the bottom face of the concavity was changed to 3.7 mm.

Protecting Agent Supplying Member 55 obtained was in the shape of a roller. The foam layer of Protecting Agent Supplying Member 55 had an interconnected cell structure and a thickness of 4 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1); the average distance (b2) between a couple of the concavities next to each other in the circumferential direction, the average width (c2) of the foam layer present between a couple of the concavities next to each other in the circumferential direction, the ratio (c2/b2), the number of cells, and the hardness of Protecting Agent Supplying Member 55 are shown in Table 3-1.

Evaluation

Evaluation was carried out in the same manner as in Example 36, provided that the protecting agent supplying member was changed to Protecting Agent Supplying Member 55. The results are shown in Tables 3-1 and 3-2.

Example 63

Production of Protecting Agent Supplying Member 56

Protecting Agent Supplying Member 56 was produced in the same manner as in Example 36, provided that the lattice pattern was changed to a lattice pattern as illustrated in FIG. 7 where a concavity and a foam were alternately aligned in the direction having 45° in angle to the parallel direction to the axial direction of the protecting agent supplying member, and the direction perpendicular to the aforementioned direction, and the average distance (a1) between the internal perimeter surface of the foam layer and the bottom face of the concavity, the average distance (a2) between the bottom face and the top face of the concavity, the average distance (b1) between a couple of the concavities next to each other in the direction having 45° in angle to the parallel direction to the axial direction, the average width (c1) of the foam layer present between a couple of the concavities next to each other in the direction having 45° in angle to the parallel direction to the axial direction, the average distance (b2) between a couple of the concavities next to each other in the direction perpendicular to the aforementioned direction, and the average width (c2) of the foam layer present between a couple of the concavities next to each other in the direction perpendicular to the aforementioned direction were respectively changed those presented in Table 3-1.

Protecting Agent Supplying Member 56 obtained was in the shape of a roller. The foam layer of Protecting Agent Supplying Member 56 had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the direction having 45° in angle to the parallel direction to the axial direction, the average width (c1) of the foam layer present between a couple of the concavities next to each other in the direction having 45° in angle to the parallel direction to the axial direction, the ratio (c1/b1), the average distance (b2) between a couple of the concavities next to each other in the direction perpendicular to the aforementioned direction, the average width (c2) of the foam layer present between a couple of the concavities next to each other in the direction perpendicular to the aforementioned direction, the ratio (c2/b2), the number of cells, and the hardness of Protecting Agent Supplying Member 56 are shown in Table 3-1.

Evaluation

Evaluation was carried out in the same manner as in Example 36, provided that the protecting agent supplying member was changed to Protecting Agent Supplying Member 56. The results are shown in Tables 3-1 and 3-2.

Examples 64 to 71

Production of Protecting Agent Supplying Members 57 to 64

Protecting Agent Supplying Members 57 to 64 were each produced in the same manner as in Example 36, provided that the average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the average distance (b2) between a couple of the concavities next to each other in the circumferential direction, and the average width (c2) of the foam layer present between a couple of the concavities next to each other in the circumferential direction were respectively changed to those presented in Table 3-1.

Protecting Agent Supplying Members 57 to 64 obtained were each in the shape of a roller. The foam layer thereof had an interconnected cell structure and a thickness of 3 mm.

The average distance (a1) between the internal perimeter surface of the foam layer and the bottom face of the concavity, the average distance (a2) between the bottom face and the top face of the concavity, the average distance (b1) between a couple of the concavities next to each other in the axial direction, the average width (c1) of the foam layer present between a couple of the concavities next to each other in the axial direction, the ratio (c1/b1), the average distance (b2) between a couple of the concavities next to each other in the circumferential direction, the average width (c2) of the foam layer present between a couple of the concavities next to each other in the circumferential direction, the ratio (c2/b2), the number of cells, and the hardness of each of Protecting Agent Supplying Members 57 to 64 are shown in Table 3-1.

Evaluation

Evaluation was carried out in the same manner as in Example 36, provided that the protecting agent supplying member was changed to the protecting agent supplying member presented in Table 3-1. The results are shown in Tables 3-1 and 3-2.

TABLE 2-1

| | Protecting agent supplying member | | | | | | | |
|---|---|---|---|---|---|---|---|---|
| | | a1 (mm) | a2 (mm) | b (mm) | c (mm) | c/b | Number of cells (per inch) | hardness (N) |
| Ex. 1 | 1 | 0.5 | 2.5 | 1.5 | 0.375 | 0.25 | 70 | 150 |
| Ex. 2 | 2 | 0.5 | 2.5 | 1.5 | 1.125 | 0.75 | 70 | 150 |
| Ex. 3 | 3 | 0.5 | 2.5 | 1.0 | 0.25 | 0.25 | 70 | 150 |
| Ex. 4 | 4 | 0.5 | 2.5 | 1.0 | 0.75 | 0.75 | 70 | 150 |
| Ex. 5 | 5 | 2.0 | 1.0 | 1.5 | 0.375 | 0.25 | 70 | 150 |
| Ex. 6 | 6 | 2.0 | 1.0 | 1.5 | 1.125 | 0.75 | 70 | 150 |
| Ex. 7 | 7 | 2.0 | 1.0 | 1.0 | 0.25 | 0.25 | 70 | 150 |
| Ex. 8 | 8 | 2.0 | 1.0 | 1.0 | 0.75 | 0.75 | 70 | 150 |
| Ex. 9 | 9 | 2.7 | 0.3 | 1.5 | 0.375 | 0.25 | 70 | 150 |
| Ex. 10 | 10 | 2.7 | 0.3 | 1.5 | 0.75 | 0.5 | 70 | 150 |
| Ex. 11 | 11 | 2.7 | 0.3 | 1.5 | 1.125 | 0.75 | 70 | 150 |
| Ex. 12 | 12 | 2.7 | 0.3 | 1.0 | 0.25 | 0.25 | 70 | 150 |
| Ex. 13 | 13 | 2.7 | 0.3 | 1.0 | 0.5 | 0.5 | 70 | 150 |
| Ex. 14 | 14 | 2.7 | 0.3 | 1.0 | 0.75 | 0.75 | 70 | 150 |
| Ex. 15 | 15 | 2.8 | 0.2 | 1.5 | 0.375 | 0.25 | 70 | 150 |
| Ex. 16 | 16 | 2.8 | 0.2 | 1.5 | 1.125 | 0.75 | 70 | 150 |
| Ex. 17 | 17 | 2.8 | 0.2 | 1.0 | 0.25 | 0.25 | 70 | 150 |
| Ex. 18 | 18 | 2.8 | 0.2 | 1.0 | 0.75 | 0.75 | 70 | 150 |
| Ex. 19 | 13 | 2.7 | 0.3 | 1.0 | 0.5 | 0.5 | 70 | 150 |
| Ex. 20 | 13 | 2.7 | 0.3 | 1.0 | 0.5 | 0.5 | 70 | 150 |
| Ex. 21 | 13 | 2.7 | 0.3 | 1.0 | 0.5 | 0.5 | 70 | 150 |
| Ex. 22 | 19 | 2.7 | 0.3 | 1.0 | 0.5 | 0.5 | 25 | 100 |
| Ex. 23 | 20 | 2.7 | 0.3 | 1.0 | 0.5 | 0.5 | 300 | 480 |
| Ex. 24 | 21 | 2.7 | 0.3 | 1.0 | 0.5 | 0.5 | 80 | 50 |
| Ex. 25 | 13 | 2.7 | 0.3 | 1.0 | 0.5 | 0.5 | 70 | 150 |
| Ex. 26 | 22 | 1.7 | 0.3 | 1.0 | 0.5 | 0.5 | 70 | 150 |
| Ex. 27 | 23 | 3.7 | 0.3 | 1.0 | 0.5 | 0.5 | 70 | 150 |
| Ex. 28 | 24 | 2.7 | 0.3 | 1.0 | 0.25 | 0.25 | 70 | 150 |
| Ex. 29 | 25 | 2.0 | 1.0 | 1.0 | 0.2 | 0.2 | 70 | 150 |
| Ex. 30 | 26 | 2.0 | 1.0 | 1.5 | 1.2 | 0.8 | 70 | 150 |
| Ex. 31 | 27 | 2.7 | 0.3 | 1.0 | 0.2 | 0.2 | 70 | 150 |
| Ex. 32 | 28 | 2.7 | 0.3 | 1.5 | 1.2 | 0.8 | 70 | 150 |
| Ex. 33 | 29 | 0.2 | 2.8 | 1.5 | 0.75 | 0.5 | 70 | 150 |
| Ex. 34 | 30 | 2.9 | 0.1 | 1.5 | 0.75 | 0.5 | 70 | 150 |
| Ex. 35 | 13 | 2.7 | 0.3 | 1.0 | 0.5 | 0.5 | 70 | 150 |
| Comp. Ex. 1 | 31 | — | — | — | — | — | 70 | 150 |

FIG. 2-2

| | Protecting agent block | | | | | |
|---|---|---|---|---|---|---|
| | | Type | | | | |
| | | Fatty acid metal salt | Inorganic lubricant | Molding method | Image bearing member filming | Charging member contamination |
| Ex. 1 | 1 | ZnST | BN | compression | C | C |
| Ex. 2 | 1 | ZnST | BN | compression | C | C |
| Ex. 3 | 1 | ZnST | BN | compression | C | C |
| Ex. 4 | 1 | ZnST | BN | compression | C | C |
| Ex. 5 | 1 | ZnST | BN | compression | B | B |
| Ex. 6 | 1 | ZnST | BN | compression | A | A |
| Ex. 7 | 1 | ZnST | BN | compression | B | B |
| Ex. 8 | 1 | ZnST | BN | compression | A | A |
| Ex. 9 | 1 | ZnST | BN | compression | A | A |
| Ex. 10 | 1 | ZnST | BN | compression | A | A |
| Ex. 11 | 1 | ZnST | BN | compression | A | A |
| Ex. 12 | 1 | ZnST | BN | compression | A | A |
| Ex. 13 | 1 | ZnST | BN | compression | A | A |
| Ex. 14 | 1 | ZnST | BN | compression | A | A |
| Ex. 15 | 1 | ZnST | BN | compression | A | A |
| Ex. 16 | 1 | ZnST | BN | compression | B | B |
| Ex. 17 | 1 | ZnST | BN | compression | A | A |
| Ex. 18 | 1 | ZnST | BN | compression | B | B |
| Ex. 19 | 4 | ZnST | — | compression | A | C |
| Ex. 20 | 2 | ZnST | talc | compression | A | A |
| Ex. 21 | 3 | ZnST | mica | compression | A | A |
| Ex. 22 | 1 | ZnST | BN | compression | B | B |
| Ex. 23 | 1 | ZnST | BN | compression | B | B |
| Ex. 24 | 1 | ZnST | BN | compression | A | A |
| Ex. 25 | 5 | ZnST | BN | fusion | A | A |
| Ex. 26 | 1 | ZnST | BN | compression | A | A |
| Ex. 27 | 1 | ZnST | BN | compression | A | A |
| Ex. 28 | 1 | ZnST | BN | compression | A | A |
| Ex. 29 | 1 | ZnST | BN | compression | C | C |
| Ex. 30 | 1 | ZnST | BN | compression | C | C |
| Ex. 31 | 1 | ZnST | BN | compression | C | C |
| Ex. 32 | 1 | ZnST | BN | compression | C | C |
| Ex. 33 | 1 | ZnST | BN | compression | C | C |
| Ex. 34 | 1 | ZnST | BN | compression | C | C |
| Ex. 35 | 6 | ZnST | — | fusion | C | C |
| Comp. Ex. 1 | 6 | ZnST | — | fusion | D | D |

In Table 2-1, "a1" denotes the average distance (a1) between the internal perimeter surface of the foam layer and the bottom face of the concavity, "a2" denotes the average distance (a2) between the bottom face and the top face of the concavity, "b" denotes the average distance (b) between a couple of the concavities next to each other, and "c" denotes the average width (c) of the foam layer present between a couple of the concavities next to each other.

In Table 2-2, "ZnST" denotes zinc stearate, and "BN" denotes boron nitride.

In Examples 1 to 35, the scattering of the powder of the protecting agent was hardly observed. Moreover, the consumption amount of the protecting agent was small in each of Examples 1 to 35, compared to an amount consumed in the case where a conventional brush roller was used as a protecting agent supplying member.

Since the protecting agent supplying member of the present invention where concavities are formed in the surface of the foam layer was used in each of Examples 1 to 35, the contact area between the protecting agent supplying member and the protecting agent block was small, but the protecting agent supplying member could sufficiently scrape the protecting agent block off under the compression condition in the range used in the actual practices. Moreover, as there were concavities, the foam layer could bend largely, which enabled to supply a large amount of the protecting agent to the image bearing member. As a result, a sufficient amount of the protecting agent could be supplied to the image bearing member, and filming of image bearing member could be prevented.

The protecting agent supplying members having the average distance (a1) between the internal perimeter surface of the foam layer and the bottom face of the concavity of 2.0 mm to 2.8 mm, i.e. 2.0 mm≤a1≤2.8 mm (e.g. Examples 5, 9, and 15) had excellent properties in terms of preventions of filming of the image bearing member and contamination of the charging member, compared to those having the average distance (a1) between the internal perimeter surface of the foam layer and the bottom face of the concavity outside the range of 2.0 mm≤a1≤2.8 mm (e.g. Examples 1, 33, and 34).

The protecting agent supplying members having the average distance (a2) between the bottom face and the top face of the concavity of 0.2 mm to 1.0 mm, i.e. 0.2 mm≤a2≤1.0 mm (e.g., Examples 5, 9, and 15) had excellent properties in terms of preventions of filming of the image bearing member and contamination of the charging member, compared to those having the average distance (a2) between the bottom face and the top face of the concavity outside the range of 0.2 mm≤a2≤1.0 mm (e.g., Examples 1, 33, and 34).

The protecting agent supplying members having the ratio (c/b) of 0.25 to 0.75, i.e. 0.25≤c/b≤0.75 (e.g. Examples 12, 13, and 14), where the ratio was a ratio of the average width (c) of the foam layer present between a couple of the concavities next to each other to the average distance (b) between a couple of the concavities next to each other had excellent properties in terms of the prevention of filming of the image bearing member, compared to those having the ratio (c/b) outside the range of 0.25≤c/b≤0.75 (e.g., Examples 31, and 32).

The protecting agent supplying members in each of which the foam layer had the number of cells that was 70 per inch to 80 per inch (e.g., Examples 13 and 24) had excellent properties in terms of preventions of filming of the image bearing member and contamination of the charging member, compared to those having the number of cells outside the range of 70 per inch to 80 per inch (e.g. Examples 22 and 23).

The protecting agent supplying members in each of which the protecting agent block was formed of a mixture of the fatty acid metal salt and the inorganic lubricant (e.g., Examples 13, 20, and 21) had excellent properties in terms of prevention of contamination of the charging member, compared to those using only the fatty acid metal salt in the protecting agent block (Example 19).

TABLE 3-1

| | Protecting agent supplying member | | | | | | | | | | |
|---|---|---|---|---|---|---|---|---|---|---|---|
| | | a1 (mm) | a2 (mm) | b1 (mm) | c1 (mm) | c1/b1 | b2 (mm) | c2 (mm) | c2/b2 | Number of cells (per inch) | Hardness (N) |
| Ex. 36 | 32 | 0.5 | 2.5 | 1.5 | 0.375 | 0.25 | 1.5 | 0.375 | 0.25 | 70 | 150 |
| Ex. 37 | 33 | 0.5 | 2.5 | 1.5 | 1.125 | 0.75 | 1.5 | 0.375 | 0.25 | 70 | 150 |

TABLE 3-1-continued

| | Protecting agent supplying member | | | | | | | | | | |
|---|---|---|---|---|---|---|---|---|---|---|---|
| | | a1 (mm) | a2 (mm) | b1 (mm) | c1 (mm) | c1/b1 | b2 (mm) | c2 (mm) | c2/b2 | Number of cells (per inch) | Hardness (N) |
| Ex. 38 | 34 | 0.5 | 2.5 | 1.0 | 0.25 | 0.25 | 1.5 | 1.125 | 0.75 | 70 | 150 |
| Ex. 39 | 35 | 0.5 | 2.5 | 1.0 | 0.75 | 0.75 | 1.5 | 1.125 | 0.75 | 70 | 150 |
| Ex. 40 | 36 | 2.0 | 1.0 | 1.5 | 0.375 | 0.25 | 1.0 | 0.25 | 0.25 | 70 | 150 |
| Ex. 41 | 37 | 2.0 | 1.0 | 1.5 | 1.125 | 0.75 | 1.0 | 0.25 | 0.25 | 70 | 150 |
| Ex. 42 | 38 | 2.0 | 1.0 | 1.0 | 0.25 | 0.25 | 1.0 | 0.75 | 0.75 | 70 | 150 |
| Ex. 43 | 39 | 2.0 | 1.0 | 1.0 | 0.75 | 0.75 | 1.0 | 0.75 | 0.75 | 70 | 150 |
| Ex. 44 | 40 | 2.7 | 0.3 | 1.5 | 0.375 | 0.25 | 1.5 | 0.375 | 0.25 | 70 | 150 |
| Ex. 45 | 41 | 2.7 | 0.3 | 1.5 | 0.75 | 0.5 | 1.5 | 1.125 | 0.75 | 70 | 150 |
| Ex. 46 | 42 | 2.7 | 0.3 | 1.5 | 1.125 | 0.75 | 1.5 | 0.375 | 0.25 | 70 | 150 |
| Ex. 47 | 43 | 2.7 | 0.3 | 1.0 | 0.25 | 0.25 | 1.5 | 1.125 | 0.75 | 70 | 150 |
| Ex. 48 | 44 | 2.7 | 0.3 | 1.0 | 0.5 | 0.5 | 1.5 | 0.375 | 0.25 | 70 | 150 |
| Ex. 49 | 45 | 2.7 | 0.3 | 1.0 | 0.75 | 0.75 | 1.5 | 1.125 | 0.75 | 70 | 150 |
| Ex. 50 | 46 | 2.8 | 0.2 | 1.5 | 0.375 | 0.25 | 1.0 | 0.5 | 0.5 | 70 | 150 |
| Ex. 51 | 47 | 2.8 | 0.2 | 1.5 | 1.125 | 0.75 | 1.0 | 0.5 | 0.5 | 70 | 150 |
| Ex. 52 | 48 | 2.8 | 0.2 | 1.0 | 0.25 | 0.25 | 1.0 | 0.5 | 0.5 | 70 | 150 |
| Ex. 53 | 49 | 2.8 | 0.2 | 1.0 | 0.75 | 0.75 | 1.0 | 0.5 | 0.5 | 70 | 150 |
| Ex. 54 | 50 | 2.7 | 0.3 | 1.0 | 0.5 | 0.5 | 1.0 | 0.5 | 0.5 | 70 | 150 |
| Ex. 55 | 50 | 2.7 | 0.3 | 1.0 | 0.5 | 0.5 | 1.0 | 0.5 | 0.5 | 70 | 150 |
| Ex. 56 | 50 | 2.7 | 0.3 | 1.0 | 0.5 | 0.5 | 1.0 | 0.5 | 0.5 | 70 | 150 |
| Ex. 57 | 51 | 2.7 | 0.3 | 1.0 | 0.5 | 0.5 | 1.0 | 0.5 | 0.5 | 25 | 100 |
| Ex. 58 | 52 | 2.7 | 0.3 | 1.0 | 0.5 | 0.5 | 1.0 | 0.5 | 0.5 | 300 | 480 |
| Ex. 59 | 53 | 2.7 | 0.3 | 1.0 | 0.5 | 0.5 | 1.0 | 0.5 | 0.5 | 80 | 50 |
| Ex. 60 | 50 | 2.7 | 0.3 | 1.0 | 0.5 | 0.5 | 1.0 | 0.5 | 0.5 | 70 | 150 |
| Ex. 61 | 54 | 1.7 | 0.3 | 1.0 | 0.5 | 0.5 | 1.0 | 0.5 | 0.5 | 70 | 150 |
| Ex. 62 | 55 | 3.7 | 0.3 | 1.0 | 0.5 | 0.5 | 1.0 | 0.5 | 0.5 | 70 | 150 |
| Ex. 63 | 56 | 2.7 | 0.3 | 1.0 | 0.25 | 0.25 | 1.0 | 0.5 | 0.5 | 70 | 150 |
| Ex. 64 | 57 | 2.0 | 1.0 | 1.0 | 0.2 | 0.2 | 1.0 | 0.2 | 0.2 | 70 | 150 |
| Ex. 65 | 58 | 2.0 | 1.0 | 1.5 | 1.2 | 0.8 | 1.5 | 1.2 | 0.8 | 70 | 150 |
| Ex. 66 | 59 | 2.7 | 0.3 | 1.0 | 0.2 | 0.2 | 1.0 | 0.2 | 0.2 | 70 | 150 |
| Ex. 67 | 60 | 2.7 | 0.3 | 1.5 | 1.2 | 0.8 | 1.5 | 1.2 | 0.8 | 70 | 150 |
| Ex. 68 | 61 | 0.2 | 2.8 | 1.5 | 0.75 | 0.5 | 1.5 | 0.75 | 0.5 | 70 | 150 |
| Ex. 69 | 62 | 2.9 | 0.1 | 1.5 | 0.75 | 0.5 | 1.5 | 0.75 | 0.5 | 70 | 150 |
| Ex. 70 | 63 | 2.7 | 0.3 | 1.0 | 0.5 | 0.5 | 1.0 | 0.2 | 0.2 | 70 | 150 |
| Ex. 71 | 64 | 2.7 | 0.3 | 1.0 | 0.5 | 0.5 | 1.0 | 0.8 | 0.8 | 70 | 150 |

TABLE 3-2

| | Protecting agent block No. | Filming of image bearing member | Contamination of charging member |
|---|---|---|---|
| Ex. 36 | 1 | C | C |
| Ex. 37 | 1 | C | C |
| Ex. 38 | 1 | C | C |
| Ex. 39 | 1 | C | C |
| Ex. 40 | 1 | B | B |
| Ex. 41 | 1 | A | A |
| Ex. 42 | 1 | B | B |
| Ex. 43 | 1 | A | A |
| Ex. 44 | 1 | A | A |
| Ex. 45 | 1 | A | A |
| Ex. 46 | 1 | A | A |
| Ex. 47 | 1 | A | A |
| Ex. 48 | 1 | A | A |
| Ex. 49 | 1 | A | A |
| Ex. 50 | 1 | A | A |
| Ex. 51 | 1 | B | B |
| Ex. 52 | 1 | A | A |
| Ex. 53 | 1 | B | B |
| Ex. 54 | 4 | A | C |
| Ex. 55 | 2 | A | A |
| Ex. 56 | 3 | A | A |
| Ex. 57 | 1 | B | B |
| Ex. 58 | 1 | B | B |
| Ex. 59 | 1 | A | A |
| Ex. 60 | 5 | A | A |
| Ex. 61 | 1 | A | A |
| Ex. 62 | 1 | A | A |
| Ex. 63 | 1 | A | A |
| Ex. 64 | 1 | C | C |
| Ex. 65 | 1 | C | C |
| Ex. 66 | 1 | C | C |

TABLE 3-2-continued

| | Protecting agent block No. | Filming of image bearing member | Contamination of charging member |
|---|---|---|---|
| Ex. 67 | 1 | C | C |
| Ex. 68 | 1 | C | C |
| Ex. 69 | 1 | C | C |
| Ex. 70 | 1 | C | C |
| Ex. 71 | 1 | C | C |

In Table 3-1, "a1" denotes the average distance (a1) between the internal perimeter surface of the foam layer and the bottom face of the concavity, "a2" denotes the average distance (a2) between the bottom face and the top face of the concavity, "b1" denotes the average distance (b1) between a couple of the concavities next to each other, "c1" denotes the average width (c1) of the foam layer present between a couple of the concavities next to each other, "b2" denotes the average distance (b2) between a couple of the concavities next to each other, and "c2" denotes the average width (c2) of the foam layer present between a couple of the concavities next to each other.

In Examples 36 to 71, the scattering of the powder of the protecting agent was hardly observed. Moreover, the consumption amount of the protecting agent was small in each of Examples 36 to 71, compared to an amount consumed in the case where a conventional brush roller was used as a protecting agent supplying member.

Since the protecting agent supplying member of the present invention where concavities are formed in the surface of the foam layer was used in each of Examples 36 to 71, the contact area between the protecting agent supplying member and the protecting agent block was small, but the protecting agent supplying member could sufficiently scrape the protecting agent block off under the compression condition in the range used in the actual practices. Moreover, as there were concavities, the foam layer could bend largely, which enabled to supply a large amount of the protecting agent to the image bearing member. As a result, a sufficient amount of the protecting agent could be supplied to the image bearing member, and filming of image bearing member could be prevented.

Since the protecting agent supplying member of the present invention, which is in the shape of a roller and has a foam layer, can prevent scattering of a powdery protecting agent generated as rubbed by the roller-shaped protecting agent supplying member, suppress a consumption amount of the protecting agent, and prevent filming, the protecting agent supplying member of the present invention is suitably used in an electrophotographic image forming method, image forming apparatus and process cartridge.

What is claimed is:

1. A protecting agent supplying member, comprising:
a core; and
a foam layer formed on a periphery of the core,
wherein the protecting agent supplying member is in the shape of a roller, and
wherein the foam layer has concavities regularly arranged in a surface thereof,
the concavities being substantially uniform and being arranged at constant intervals along a circumferential direction of the roller.

2. The protecting agent supplying member according to claim 1, wherein the protecting agent supplying member satisfies the relationships of:
$a1 \geq 0.5$ mm, and
$a2 \geq 0.2$ mm,
where a1 is the average distance between an internal perimeter surface of the foam layer and a bottom face of the concavity, and a2 is the average distance between the bottom face of the concavity and a top face of the concavity.

3. The protecting agent supplying member according to claim 1, wherein the protecting agent supplying member has the ratio c/b in the range of:
$0.25 \leq c/b \leq 0.75$,
where b is the average distance between a couple of the concavities next to each other, and c is the average width of the form layer present between a couple of the concavities next to each other.

4. The protecting agent supplying member according to claim 1, wherein the concavities are arranged in a lattice pattern.

5. The protecting agent supplying member according to claim 4, wherein the concavities arranged in the lattice pattern have the ratio c1/b1 and the ratio c2/b2 in the respective ranges of
$0.25 \leq c1/b1 \leq 0.75$, and
$0.25 \leq c2/b2 \leq 0.75$,
where b1 is the average distance between a couple of the concavities next to each other with respect to one direction, c1 is the average width of the foam layer present between a couple of the concavities next to each other with respect to the one direction, b2 is the average distance between a couple of the concavities next to each other with respect to the direction perpendicular to the one direction, and c2 is the average width of the foam layer present between a couple of the concavities next to each other with respect to the direction perpendicular to the one direction.

6. The protecting agent supplying member according to claim 1, wherein the foam layer contains polyurethane foam.

7. The protecting agent supplying member according to claim 1, wherein the foam layer is a foam layer of an interconnected cell structure.

8. The protecting agent supplying member according to claim 1, wherein the foam layer contains 25 cells per inch to 300 cells per inch, and has hardness of 50 N to 500 N.

9. A protective layer forming device, comprising:
a protecting agent block; and
a protecting agent supplying member,
wherein the protecting agent supplying member contains:
a core; and
a foam layer formed on a periphery of the core,
wherein the protecting agent supplying member is in the shape of a roller,
wherein the foam layer has concavities regularly arranged in a surface thereof,
and wherein the concavities are substantially uniform and are arranged at constant intervals along a circumferential direction of the roller.

10. The protective layer forming device according to claim 9, wherein the protecting agent block contains a fatty acid metal salt and an inorganic lubricant.

11. The protective layer forming device according to claim 10, wherein the fatty acid metal salt is zinc stearate.

12. The protective layer forming device according to claim 10, wherein the inorganic lubricant is boron nitride.

13. The protective layer forming device according to claim 9, further comprising:
a pressing force applying member configured to press the protecting agent block so as to bring the protecting agent block into contact with the protecting agent supplying member; and
a protective layer forming member configured to thinly level a protecting agent provided on a surface of an image bearing member to form a protective layer.

14. The protective layer forming device according to claim 9, wherein the protecting agent supplying member satisfies the relationships of:
$a1 \geq 0.5$ mm, and
$a2 \geq 0.2$ mm,
where a1 is the average distance between an internal perimeter surface of the foam layer and a bottom face of the concavity, and a2 is the average distance between the bottom face of the concavity and a top face of the concavity.

15. The protective layer forming device according to claim 9, wherein the foam layer has the ratio c/b in the range of:
$0.25 \leq c/b \leq 0.75$
where b is the average distance between a couple of the concavities next to each other, and c is the average width of the foam layer present between a couple of the concavities next to each other.

16. The protective layer forming device according to claim 9, wherein the concavities are arranged in a lattice pattern in the foam layer.

17. An image forming apparatus, comprising:
an image bearing member;
a latent electrostatic image forming member configured to form a latent electrostatic image on the image bearing member;
a developing unit configured to develop the latent electrostatic image with a toner to form a visible image;

a transferring unit configured to transfer the visible image onto a recording medium;

a protective layer forming unit configured to provide a protecting agent to a surface of the image bearing member, from which the visible image has been transferred, to form a protective layer; and a fixing unit configured to fix the transferred visible image on the recording medium, wherein the protective layer forming unit is a protective layer forming device, which contains:

a core; and a foam layer formed on a periphery of the core, wherein the protecting agent supplying member is in the shape of a roller, and wherein the foam layer has concavities regularly arranged in a surface thereof and wherein the concavities are substantially uniform and are arranged at constant intervals along a circumferential direction of the roller.

18. The image forming apparatus according to 17, wherein the protecting agent supplying member satisfies the relationships of:

$a1 \geq 0.5$ mm, and $a2 \geq 0.2$ mm, where a1 is the average distance between an internal perimeter surface of the foam layer and a bottom face of the concavity, and a2 is the average distance between the bottom face of the concavity and a top face of the concavity.

19. The image forming apparatus according to claim 17, wherein the foam layer has the ratio c/b in the range of:

$0.25 \leq c/b \leq 0.75$ where b is the average distance between a couple of the concavities next to each other, and c is the average width of the foam layer present between a couple of the concavities next to each other.

20. A protecting agent supplying member, comprising:

a core; and a foam layer formed on a periphery of the core, wherein the protecting agent supplying member is in the shape of a roller, and wherein the foam layer has concavities regularly arranged in a surface thereof, the concavities being aligned in a direction substantially parallel to an axial direction of the roller.

* * * * *